US005757392A

United States Patent [19]

Zhang

[11] Patent Number: 5,757,392

[45] Date of Patent: May 26, 1998

[54] PIEZOELECTRIC TYPE LIQUID DROPLET EJECTING DEVICE WHICH COMPENSATES FOR RESIDUAL PRESSURE FLUCTUATIONS

[75] Inventor: Qiming Zhang, Nagoya, Japan

[73] Assignee: Brother Kogyo Kabushiki Kaisha, Nagoya, Japan

[21] Appl. No.: 599,263

[22] Filed: Feb. 9, 1996

Related U.S. Application Data

[63] Continuation of Ser. No. 118,609, Sep. 10, 1993, abandoned.

[30] Foreign Application Priority Data

| | | | |
|---|---|---|---|
| Sep. 11, 1992 | [JP] | Japan | 4-269592 |
| Nov. 20, 1992 | [JP] | Japan | 4-311899 |
| Jun. 16, 1993 | [JP] | Japan | 5-144531 |

[51] Int. Cl.[6] ..... B41J 29/38

[52] U.S. Cl. ..... 347/14; 347/9

[58] Field of Search ..... 347/9–11, 14, 347/19, 68–72, 94; 310/316, 317, 328, 330; 181/206, 276

[56] References Cited

U.S. PATENT DOCUMENTS

| | | | |
|---|---|---|---|
| 4,424,520 | 1/1984 | Masuda et al. | 347/11 |
| 4,686,539 | 8/1987 | Schmidle et al. | 347/11 X |
| 4,743,924 | 5/1988 | Scardovi | 347/10 |
| 4,972,211 | 11/1990 | Aoki | 347/11 |
| 5,016,028 | 5/1991 | Temple | 347/69 |
| 5,359,350 | 10/1994 | Nakano et al. | 347/10 |

FOREIGN PATENT DOCUMENTS

| | | | |
|---|---|---|---|
| 59-176055 | 10/1984 | Japan | 347/11 |
| 61-3752 | 1/1986 | Japan . | |
| 4-64446 | 2/1992 | Japan | 347/11 |
| 4-164648 | 6/1992 | Japan . | |
| 5-162313 | 6/1993 | Japan | 347/68 |

*Primary Examiner*—Benjamin R. Fuller
*Assistant Examiner*—Charlene Dickens
*Attorney, Agent, or Firm*—Oliff & Berridge, PLC

[57] ABSTRACT

A piezoelectric-type liquid droplet ejecting device including a piezoelectric element. A predetermined voltage pulse is applied to the piezoelectric element, whereupon residual pressure fluctuations are generated in the pressure chamber of the liquid droplet ejecting device. The piezoelectric element or a separate piezoelectric element generates an electric signal corresponding to the residual pressure fluctuations. A detection circuit receives the electric signal and supplies a detection signal corresponding to the electric signal to a calculation circuit for calculating a voltage pulse. The calculation circuit supplies the voltage pulse to a drive circuit, which applies it to the piezoelectric element. The voltage pulse deforms the piezoelectric element upon application thereto in a manner sufficient to compensate for residual pressure fluctuation in the pressure chamber.

21 Claims, 14 Drawing Sheets

PIEZOELECTRIC TYPE LIQUID DROPLET EJECTING DEVICE WHICH COMPENSATES FOR RESIDUAL PRESSURE FLUCTUATIONS

This is a continuation of application Ser. No. 08/118,609 filed Sep. 10, 1993, now abandoned.

BACKGROUND OF THE INVENTION

1. Field of the Invention

The present invention relates to a piezoelectric-type liquid droplet ejecting device and more particularly to more precisely compensating for residual pressure in the pressure chamber of the piezoelectric-type liquid droplet ejecting device caused by ejecting a droplet.

2. Description of the Related Art

Piezoelectric-type liquid droplet ejecting devices are used for ejecting a variety of liquids. The printhead of ink-jet printers often include a plurality of piezoelectric-type liquid droplet ejecting devices aligned in a row. As shown in FIG. 1, a conventional piezoelectric-type liquid droplet ejecting device included in such an ink-jet printer head includes a pressure chamber 10 defined by a housing 12. An ejection liquid, ink in this example, fills the pressure chamber 10. An ink supply channel 24 for supplying ink to the pressure chamber 10 is formed in one side of the housing 12 and a nozzle 22 through which ink is ejected is formed in the other. To a resilient side wall 14 of the housing 12 is provided a piezoelectric element 16, for example, a PZT (lead zirconate titanate) piezoelectric transducer. A pair of electrodes (not shown) are formed to opposing surfaces of the piezoelectric element 16. A drive circuit 18 is electrically connected to the electrodes of the piezoelectric element 16 for supplying a voltage thereto.

To eject ink from the pressure chamber 10 through the nozzle 22, the drive circuit 18 applies a pulse of voltage, hereinafter referred to as the drive voltage pulse, to an electrode of the piezoelectric element 16. The piezoelectric element 16, and consequently the resilient side wall 14, deforms to the shape indicated by the one-dash chain line. The internal volume of the pressure chamber 10 reduces accordingly, which increases the pressure of the pressure chamber 10, ejecting an ink droplet 20 from the nozzle 22. When the drive voltage pulse is completed and voltage applied by the drive circuit 30 returns to zero volts, the piezoelectric element 16 returns to its initial shape (shape before it deformed), the volume in the pressure chamber 10 increases, and the pressure in the pressure chamber 10 decreases so that ink is sucked from the ink supply channel 24 into the pressure chamber 10.

The change in volume which ejects ink also generates a pressure wave in the pressure chamber 10. The pressure wave propagates via the ink medium in all directions throughout the pressure chamber 10 and crosses the pressure chamber 10 several times by reflecting off the housing 12 attenuating as it progresses. This pressure wave causes residual pressure fluctuations in the pressure chamber 10. Such residual pressure fluctuations, especially those near the nozzle, affect successive ink ejections. As shown in FIG. 2, as a result of the pressure wave, the pressure near the nozzle 22 fluctuates at a set cycle, with positive and negative pressure peaks, even after the piezoelectric element 16 returns to its initial shape upon the lowering edge of the drive voltage pulse. The set cycle of the residual pressure fluctuation is determined by the form of the pressure chamber 10 and the propagation speed of the pressure wave.

If the drive voltage pulse to eject a successive droplet is applied at time A shown by the one-dash chain line in FIG. 2, although deformation of the piezoelectric element 16 will reduce the volume of the pressure chamber 10, because the pressure near the nozzle 22 is negative due to pressure fluctuations caused by the pressure wave of the previous ink ejection, pressure may not increase sufficiently in the pressure chamber 10 to eject an ink droplet. Even if pressure is sufficient to eject an ink droplet, the actual speed and volume of the droplet may vary from the desired speed and volume, causing variations in the printed characters. When succeeding ink ejections are performed varies greatly with desired character patterns, print speeds, and the like. Residual pressure fluctuations cause considerable variations in the ejection speed and volume of ink droplets.

There has been known a piezoelectric-type liquid droplet ejecting device, such as that described in Japanese Patent Application Kokai No. SHO-61-3752, which attempts to reduce residual pressure fluctuations in the pressure chamber 10. The concept behind this liquid droplet ejecting device is to attempt to negate the residual pressure fluctuation by applying a negative cancellation pressure to the pressure chamber 10 when the residual pressure fluctuation is thought to be at a positive pressure peak. The negative cancellation pressure is generated by applying a cancel voltage pulse to the piezoelectric element 16. The cancel voltage pulse is a voltage pulse applied to the piezoelectric element 16, but with current reverse to that applied during ink ejection. Upon application of the cancel voltage pulse, the piezoelectric element 16 deforms outwardly, that is, in the opposite direction as during ink ejection, increasing the volume in the pressure chamber 10 and consequently reducing the pressure therein. Ideally, when the residual pressure near the nozzle 22 becomes high, as at time B in FIG. 2, a cancel voltage pulse is applied to the piezoelectric element 16. The cancel voltage pulse applied at this time will cause the piezoelectric element 16 to deform, thereby increasing the volume within the pressure chamber 10, and negating the residual pressure as indicated by the broken line in FIG. 2.

The cycle of the residual pressure fluctuation varies with the shape of the pressure chamber 10, that is, the distance from the ink supply channel 24 to the nozzle 22, and the propagation speed of the pressure wave in the pressure chamber 10. Also, the strength of the residual pressure depends on the attenuation rate of the pressure wave. Therefore when and at what strength the cancel voltage pulse is to be applied in the device described in Japanese Patent Application Kokai No. SHO-61-3752 is predetermined by tests which take these variables into account. The time of application and strength of the cancel voltage pulse can also be manually adjusted in this device to take into account dimensional errors. Also reducing the volume in the pressure chamber 10 to increase pressure when the residual pressure is negative also negates the residual pressure.

However, there has been known a problem with conventional piezoelectric-type liquid droplet ejecting devices in that fluctuations in residual pressure are affected by the qualities of the ink, the ambient environment (that is, where the device is used), and the like. For example, the propagation speed of the pressure wave is affected by changes in temperature. Also, the rate at which the pressure wave attenuates changes with the qualities of the ink and the abundance of air bubbles mixed in the ink. Changes brought about by causes such as these change the cycle and the amplitude of the residual pressure fluctuations, invalidating the effectiveness of predetermined cancel voltage pulses. When the time of application of the cancel voltage pulse is only slightly off, predetermined cancel voltage pulses will only partially reduce residual pressure. If time of application of the cancel voltage pulse is off by a half cycle, the pressure waves will actually be strengthened.

Although some piezoelectric-type liquid droplet ejecting devices, as described above, can be readjusted to eliminate residual pressure fluctuations by compensating for changes in the ambient environment, these adjustments require troublesome operations and, moreover, a great deal of skill, so they are not always practical.

SUMMARY OF THE INVENTION

It is therefore an object of the present invention to overcome the above-described drawbacks, and to provide a piezoelectric-type liquid droplet ejecting device which compensates for residual pressure fluctuations regardless of changes in the ambient environment and qualities of the ink. The present invention compensates for residual pressure fluctuations in the pressure chamber by, for example, negating the residual pressure fluctuation by applying a cancel voltage pulse to the piezoelectric element, by timing the application of successive voltage pulses for ejecting droplets to when the residual pressure detected in the pressure chamber is at, for example, a maximum pressure value or at zero pressure, or by modifying successive voltage pulses for ejecting droplets to meet other parameters of the residual pressure detected in the pressure chamber so as to successfully eject successive liquid droplets.

A piezoelectric-type liquid droplet ejecting device according to the present invention for ejecting a liquid from a pressure chamber, the pressure chamber having an internal volume for containing the liquid, may include a piezoelectric element for changing the internal volume of the pressure chamber in response to application of electric voltage; a residual pressure fluctuation detection means for detecting residual pressure fluctuation, the residual pressure fluctuation being generated in the pressure chamber by application of a predetermined voltage pulse with a predetermined parameter to the piezoelectric element, the piezoelectric element deforming upon application of the predetermined voltage pulse; and a residual pressure fluctuation compensating means, for determining a compensation voltage pulse based on the residual pressure fluctuation detected by the residual pressure fluctuation detection means and for applying the compensation voltage pulse to the piezoelectric element, the compensation voltage pulse deforming the piezoelectric element upon application thereto in a manner sufficient to compensate for residual pressure fluctuation in the pressure chamber.

The residual pressure fluctuation detection means preferably includes a detection element for generating an electric signal corresponding to residual pressure fluctuations in the pressure chamber, and a detection circuit connected to the detection element for receiving the electric signal and supplying a detection signal corresponding to the electric signal to the residual pressure fluctuation compensating means, and the residual pressure fluctuation compensation means preferably includes a calculation circuit for calculating the compensation voltage pulse based on residual pressure fluctuations as detected by the detection means, and a drive circuit for applying the compensation voltage pulse to the piezoelectric element.

The calculation circuit preferably determines voltage, duration, and time of application of the compensation voltage pulse as required for negating the residual pressure fluctuation in the pressure chamber.

The drive circuit preferably applies the compensation voltage pulse calculated in the calculation circuit to the piezoelectric element before application of an ejection voltage pulse, the ejection voltage pulse being of sufficient voltage and duration for causing the piezoelectric element to deform sufficiently to eject a liquid droplet from the pressure chamber.

The calculation circuit preferably includes a peak detection means for detecting a peak in the electric signal; a peak level detection means for detecting a level of the peak; a half cycle calculation means for calculating a half cycle of the electric signal: a phase calculation means for calculating a phase based on the predetermined voltage pulse and the peak electric signal; and a compensation voltage pulse calculation means for calculating the voltage of the compensation voltage pulse based on the level of the peak, the pulse width of the compensation voltage pulse based on the half cycle, and the application time of the compensation voltage pulse based on the phase.

The detection element may include the piezoelectric element, the piezoelectric element being deformed by residual pressure fluctuations in the pressure chamber, the piezoelectric element generating the electric signal by the piezoelectric electric effect corresponding to the residual pressure fluctuations, the piezoelectric element supplying the electric signal to the detection circuit, and the drive circuit preferably selectively applying the compensation voltage pulse and the ejection voltage pulse to the piezoelectric element.

The drive circuit may include an isolation means for electrically isolating the drive circuit from the piezoelectric element during detection of residual pressure fluctuation in the pressure chamber.

The detection element may include another piezoelectric element, the another piezoelectric element being deformed by residual pressure fluctuations in the pressure chamber, the another piezoelectric element generating the electric signal by the piezoelectric electric effect corresponding to the residual pressure fluctuations, the another piezoelectric element supplying the electric signal to the detection circuit, and the drive circuit selectively applying the ejection voltage pulse and the compensation voltage pulse to the piezoelectric element.

The predetermined voltage pulse may be of sufficient voltage and duration for causing the piezoelectric element to deform sufficiently to eject a liquid droplet from the pressure chamber.

The piezoelectric-type liquid droplet ejecting device may further include a predetermined voltage pulse application means for applying the predetermined voltage pulse to the piezoelectric element; and a memory means for storing a waveform of the compensation voltage pulse calculated in the calculation circuit and for supplying the compensation voltage pulse to the drive circuit.

The compensation voltage pulse may include a combination of an ejection voltage pulse being of sufficient voltage and duration for causing the piezoelectric element to deform sufficiently to eject a liquid droplet from the pressure chamber; and a cancel voltage pulse being of sufficient voltage and duration for negating residual pressure fluctuation upon being applied to the piezoelectric element, the residual pressure fluctuation being generated in the pressure chamber by application of the ejection voltage pulse to the piezoelectric element.

The calculation circuit may include a peak detection means for detecting a peak and an ensuing peak In the electric signal; a peak level detection means for detecting the peak level of the peak, and the ensuing peak level of the ensuing peak; a half cycle calculation means for calculating a half cycle of the electric signal corresponding to the time duration between when the peak level is detected and when the ensuing peak level is detected; an attenuation calculation means for calculating an attenuation rate based on the ratio of the peak level and the ensuing peak level; and a compensation voltage pulse waveform calculation means for calculating the waveform of the compensation voltage pulse so that an amplitude of the ejection voltage pulse and an amplitude of the cancel voltage pulse are at a ratio substantially equal to the ratio of the peak level and the ensuing peak level, so that the ejection voltage pulse and the cancel voltage pulse are respectively applied at durations substantially equal to the half cycle, and so that the cancel voltage pulse is applied substantially one half cycle after completion of application of the ejection voltage pulse.

The detection element may include the piezoelectric element, the piezoelectric element being deformed by residual pressure fluctuations in the pressure chamber, the piezoelectric element generating the electric signal by the piezoelectric electric effect corresponding to the residual pressure fluctuations, the piezoelectric element supplying the electric signal to the detection circuit, and the drive circuit may selectively apply the compensation voltage pulse and the ejection voltage pulse to the piezoelectric element.

The drive circuit may include an isolation means for electrically isolating the drive circuit from the piezoelectric element during detection of the residual pressure fluctuation in the pressure chamber.

The detection element may include second piezoelectric element, the second piezoelectric element being deformed by residual pressure fluctuations in the pressure chamber, the second piezoelectric element generating the electric signal by the piezoelectric electric effect corresponding to the residual pressure fluctuations, the second piezoelectric element supplying the electric signal to the detection circuit, and the drive circuit selectively may apply the ejection voltage pulse and the compensation voltage pulse to the piezoelectric element.

BRIEF DESCRIPTION OF THE DRAWINGS

The above and other objects, features and advantages of the invention will become more apparent from reading the following description of the preferred embodiments taken in connection with the accompanying drawings in which:

FIG. 13

DETAILED DESCRIPTION OF THE PREFERRED EMBODIMENTS

A piezoelectric-type liquid droplet ejecting device according to preferred embodiments of the present invention will be described while referring to the accompanying drawings wherein like components and parts are provided with the same numbering to avoid duplicating description. The preferred embodiments describe liquid droplet ejecting devices provided to a printhead of an ink-jet printer.

According to a first embodiment of the present invention, a piezoelectric-type liquid droplet ejecting device for ejecting a liquid from a pressure chamber through a nozzle by changing the internal volume of the pressure chamber using a piezoelectric transducer, includes a pressure fluctuation detection means, for detecting residual pressure fluctuation in the pressure chamber caused by ejection of a liquid droplet, and a pressure fluctuation negating means, for negating the residual pressure in the pressure chamber by applying a voltage pulse, the voltage and time of application based on the residual pressure fluctuation as determined by the pressure fluctuation detection means, to the piezoelectric transducer to change the internal volume of the pressure chamber.

Figure 1:
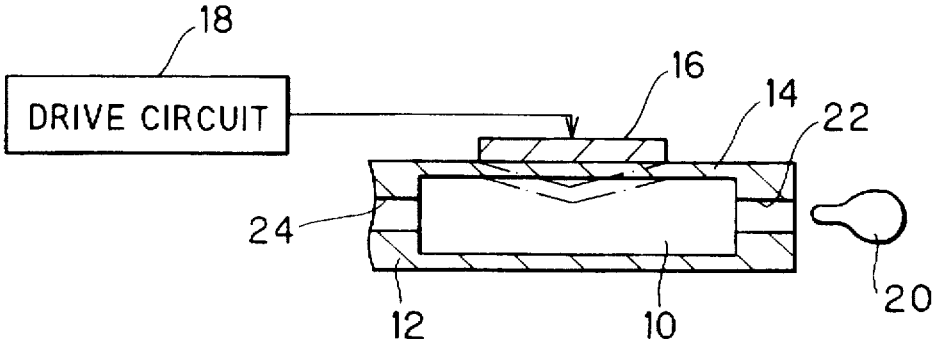
FIG. 1 RELATED ART
FIG. 1 is a cross-sectional view showing a conventional liquid droplet ejecting device.
Figure 2:
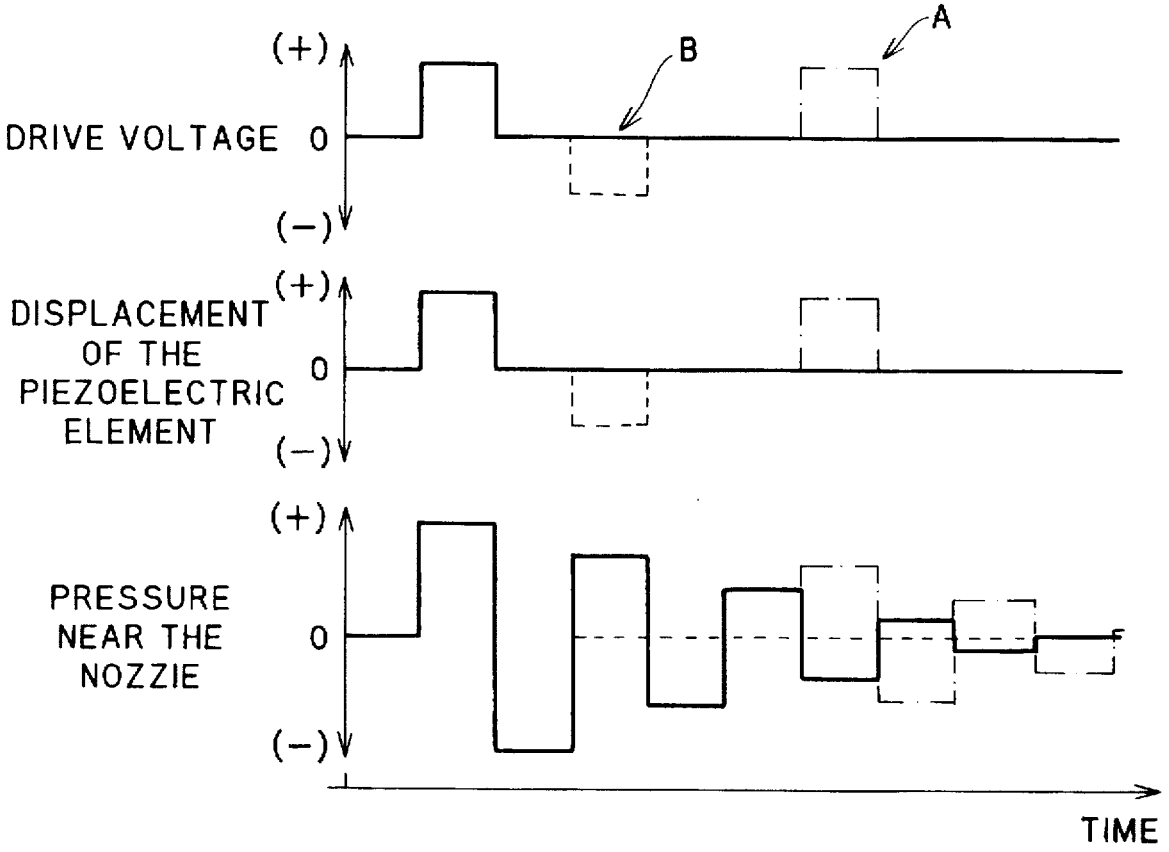
FIG. 2 RELATED ART
FIG. 2 is a timing chart showing residual pressure fluctuations generated in a pressure chamber of the conventional liquid droplet ejecting device shown in FIG. 1.
Figure 3:
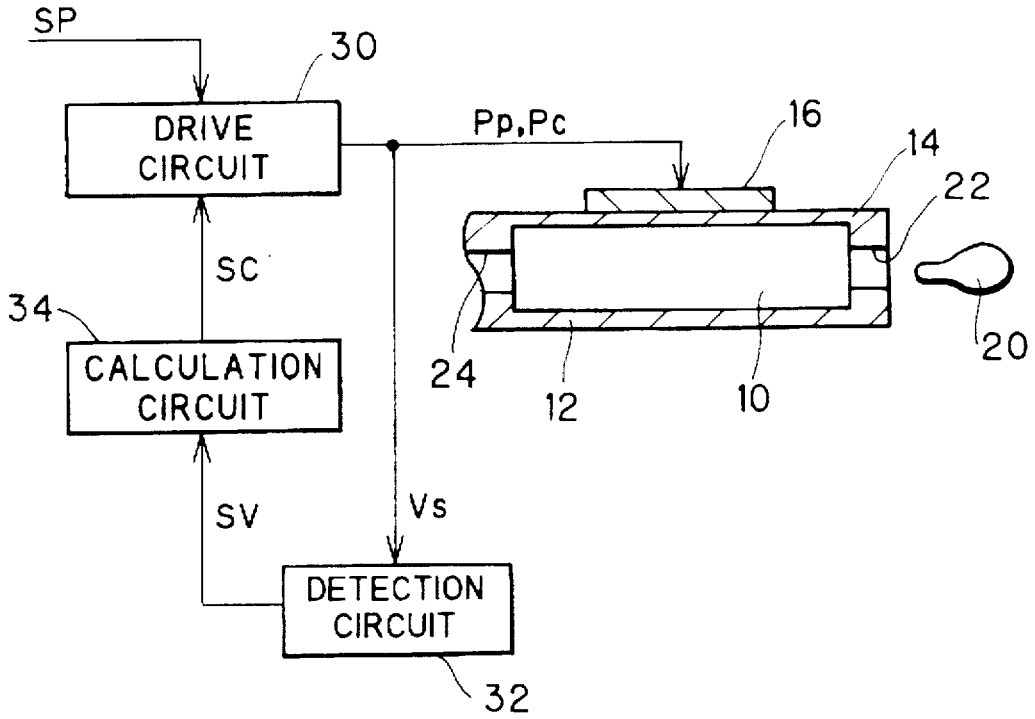
FIG. 3 is a cross-sectional view of a liquid droplet ejecting device according to a first example of a first preferred embodiment.

As shown in FIG. 3, a first example of a piezoelectric-type liquid droplet ejecting device according to the first embodiment of the present invention includes a drive circuit 30, a detection circuit 32, and a calculation circuit 34. The drive circuit 30 is connected to a printer control circuit (not shown), for receiving input of a print signal SP therefrom, and the calculation circuit 34, for receiving input of a cancel signal SC therefrom. The drive circuit 30 is connected to the piezoelectric element 16 for selectively supplying a print voltage pulse PP and a cancel voltage pulse PC thereto. The detection circuit 32 is connected to the line between the drive circuit 30 and the piezoelectric element 16 for detecting an electric signal VS therefrom. The detection circuit 32 is connected to the calculation circuit 34 for supplying a detection signal SV thereto.

Figure 4:
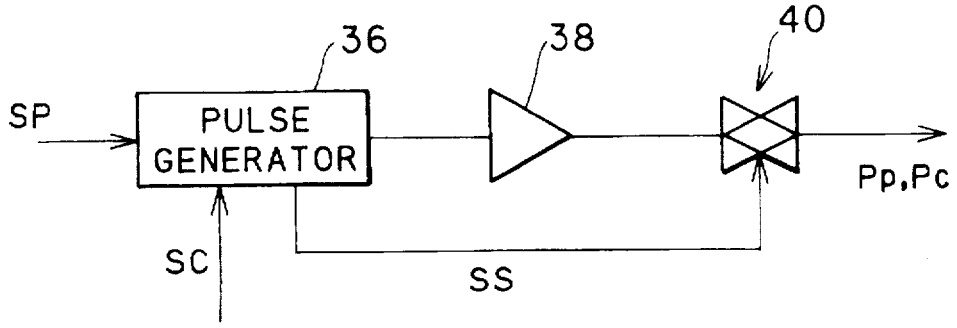
FIG. 4 is a circuit diagram showing components of a drive circuit of the liquid droplet ejecting device shown in FIG. 3.

As shown in FIG. 4, the drive circuit 30 includes a pulse generator 36, an amp 38, and an analog switch 40. The pulse generator 36 is connected to the printer control circuit (not shown), for receiving the print signal SP therefrom, the calculation circuit 34, for receiving the cancel signal SC therefrom, and the analog switch 40, for supplying a switch signal SS thereto. The pulse generator 36 is also connected to the analog switch 40 via the amp 38. The analog switch 40 is connected to the piezoelectric element 16 for supplying the print voltage pulse PP and the cancel voltage pulse PC thereto.

The drive circuit 30 applies to the piezoelectric element 16 either a print voltage pulse PP, in response to a print signal SP inputted from the print controller, or a cancel voltage pulse PC, in response to a cancel signal SC inputted from the calculation circuit 34. The waveform of the print voltage pulse PP is predetermined as required to sufficiently deform the piezoelectric element 16 for ejecting an ink droplet 20. The waveform of the cancel voltage pulse PC, however, is controlled according to the voltage and pulse width of the cancel signal SC. As will be described in more detail later, the waveform of the cancel voltage pulse PC is required to sufficiently deform the piezoelectric element 16 to negate residual pressure fluctuations generated in the pressure chamber 10 when an ink droplet is ejected. When residual pressure is to be detected, the pulse generator 36 outputs a switch signal SS to the analog switch 40. That is, when residual pressure fluctuation in the pressure chamber 10 is being detected as will be described below, the switch signal SS interrupts the analog switch 40, electrically disconnecting the drive circuit 30 from the piezoelectric element 16.

Figure 5:
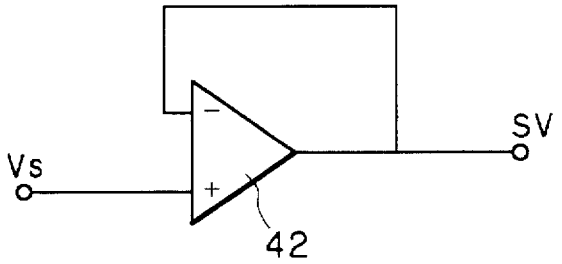
FIG. 5 is a circuit diagram showing components of a detection circuit of the liquid droplet ejecting device shown in FIG. 3.
Figure 7:
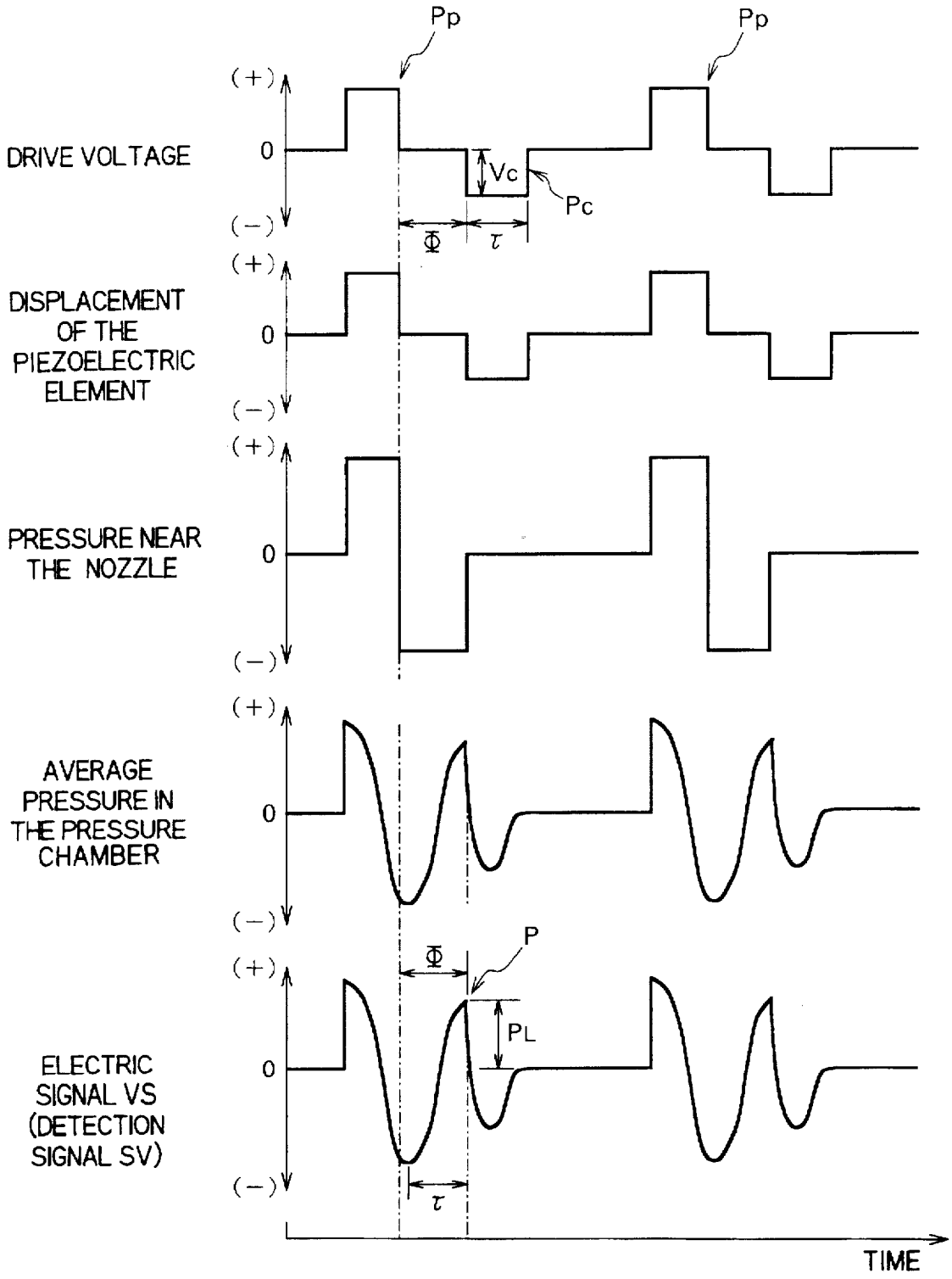
FIG. 7 is a timing chart showing correspondence of fluctuations in pressure within a pressure chamber, and voltage applied to a piezoelectric element, of the liquid droplet ejecting device shown in FIG. 3.

Residual pressure fluctuations in the pressure chamber 10 generated after application of a print voltage pulse PP apply pressure to the piezoelectric element 16. The piezoelectric effect causes the piezoelectric element 16 to generate an electric signal VS in response to this pressure. The detection circuit 32 including, for example, a voltage follower op amp 42 as shown in FIG. 5 detects the electric signal VS and outputs a detection signal SV identical to the electric signal VS to the calculation circuit 34. The op amp 42 acts as a buffer, that is, prevents measurements performed on the detection signal SV (as will be described later when explaining the calculation circuit) from affecting the electric signal VS. Fluctuations in the electric signal VS and the detection signal SV correspond to fluctuations in the average pressure in the pressure chamber 10 as indicated in FIG. 7. Stated differently, the electric signal VS and the detection signal SV change in correspondence with residual pressure fluctuations in the pressure chamber 10.

Figure 6:
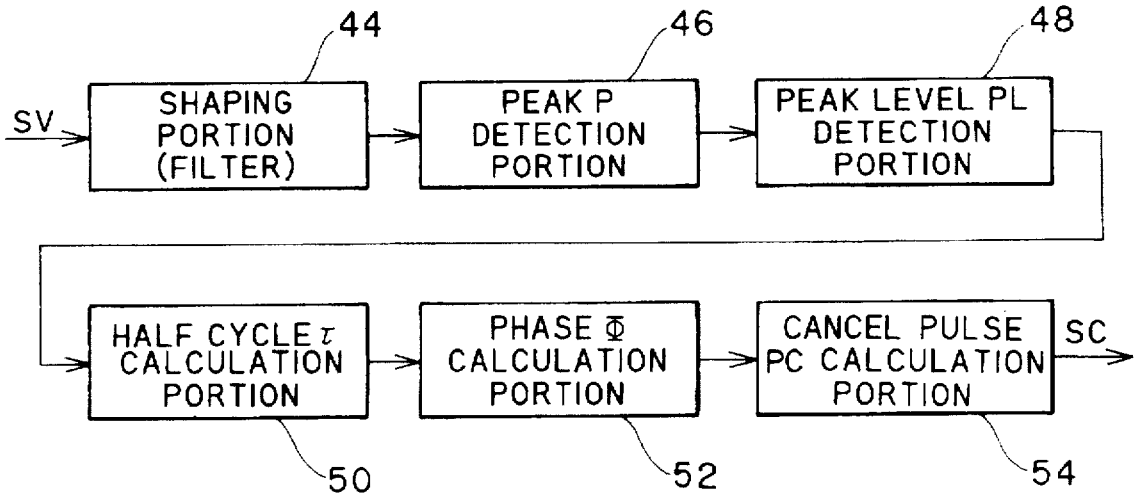
FIG. 6 is a circuit diagram showing components of a calculation circuit of the liquid droplet ejecting device shown in FIG. 3.

The calculation circuit 34 calculates, based on the detection signal SV, the cancel voltage pulse PC required for negating residual pressure fluctuations in the pressure chamber 10. The calculation circuit 34 includes, for example, a microcomputer as shown in FIG. 6 that includes a shaping portion (filter) 44, a peak P detection portion 46, a peak level PL detection portion 48, a half cycle $\tau$ calculation portion 50, a phase $\phi$ calculation portion 52, and a cancel voltage pulse PC calculation portion 54, connected serially in the order listed. The shaping portion 44, connected to the detection circuit 32, filters out or otherwise eliminates noise included in the detection signal SV outputted from the detection circuit 32. The peak detection portion 46 detects a first peak P in the detection signal SV outputted from the shaping portion 44. The first peak P corresponds to the first positive pressure peak in the residual pressure fluctuation in the pressure chamber 10. The peak level PL detection portion 48 detects a peak level PL in the detection signal SV. The peak level PL is the voltage value of the detection signal SV at the first peak P. The half cycle $\tau$ calculation portion 50 calculates the duration of the half cycle $\tau$ of the detection signal SV. The duration of the half cycle $\tau$ corresponds to the duration of time between the first negative pressure peak and the second positive pressure peak in the residual pressure fluctuation. The phase $\phi$ calculation portion 52 calculates a phase $\phi$. The phase $\phi$ corresponds to the time lag between the lowering edge of the print voltage pulse PP and the first peak P. The cancel voltage pulse PC calculation portion 54 calculates a cancel voltage pulse PC having a cancel voltage VC required to sufficiently deform the piezoelectric element 16 to negate the residual pressure corresponding to peak level PL. The cancel voltage VC is calculated based on the peak level P using a predetermined data map, calculation formula, or the like. The pulse width of the cancel voltage pulse PC is determined by the half cycle $\tau$. At almost the same time that the second positive pressure peak appears in the pressure chamber 10, the cancel voltage pulse PC calculation portion 54 outputs a cancel signal SC, representing the cancel voltage pulse PC, to the drive circuit 30. Said differently, the cancel voltage pulse PC calculation portion 54 outputs the cancel signal SC at a timing delayed by the phase $\phi$ after the print voltage pulse PP is completed, whereupon the drive circuit 30 applies the cancel voltage pulse PC to the piezoelectric element 16 which deforms to increase the volume in the pressure chamber 10, thereby negating the residual pressure fluctuation within the pressure chamber 10.

In a liquid droplet ejecting device according to the first example of the first preferred embodiment, the actual residual pressure fluctuation within the pressure chamber 10 is detected by the piezoelectric element 16 and the detection circuit 32. The calculation circuit 34 calculates a cancel voltage pulse PC suitable for negating the residual pressure fluctuation according to the detected pressure fluctuation and the drive circuit 30 applies it to the piezoelectric element 16. In the first preferred embodiment, the cancel voltage pulse acts as a compensation voltage pulse. Therefore, even if amplitude, cycle, and the like of the residual pressure fluctuation change because of changes such as in temperature, etc, of the ambient environment or qualities of the ink, the residual pressure fluctuation can be precisely reduced. Therefore, even in situations when performing relatively high-speed ink ejection, the pressure in pressure chamber 10 is stable and ink droplets 20 are ejected unaffected by the influence of residual pressure.

According to the first example of the first preferred embodiment, all liquid droplet ejecting devices provided to the ink-jet printer independently detect residual pressure fluctuations and output cancel voltage pulses PC accordingly. Therefore, the device appropriately controls residual pressure regardless of individual differences between the individual liquid droplet ejecting devices. Even if rapid changes in, for example, temperature or qualities of the ink during supply thereof cause the cycle, amplitude, or the like of the residual pressure fluctuation to rapidly change, the residual pressure can be sufficiently reduced because a cancel voltage pulse PC is calculated with each ejection of an ink droplet 20 according to detected residual pressure fluctuations.

In the first example of the first preferred embodiment, the piezoelectric element 16 and the detection circuit 32 act as a residual pressure fluctuation detection means and the drive circuit 30 and the calculation circuit 34 act as a residual pressure fluctuation compensation means.

Figure 8:
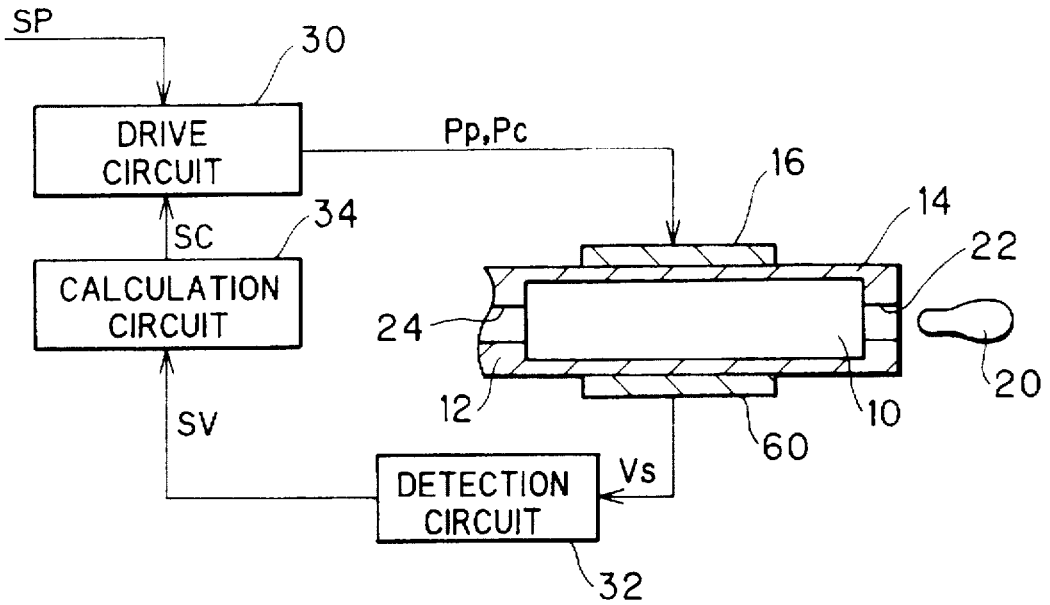
FIG. 8 is a cross-sectional view of a liquid droplet ejecting device according to a second example of the first preferred embodiment.

The following text describes a piezoelectric-type liquid droplet ejecting device according to a second example of the first preferred embodiment which, as shown in FIG. 8, is generally the same as the piezoelectric-type liquid droplet ejecting device according to the first example, except for an additional pressure detection piezoelectric element 60. Because the drive circuit 30 and the detection circuit 32 are electrically isolated in this case, fluctuations in residual pressure can be more accurately detected and also the analog switch can be omitted. The pressure detection piezoelectric element 60 and the detection circuit 32 in the second example of the preferred embodiment act as a residual pressure fluctuation detection means.

Figure 9:
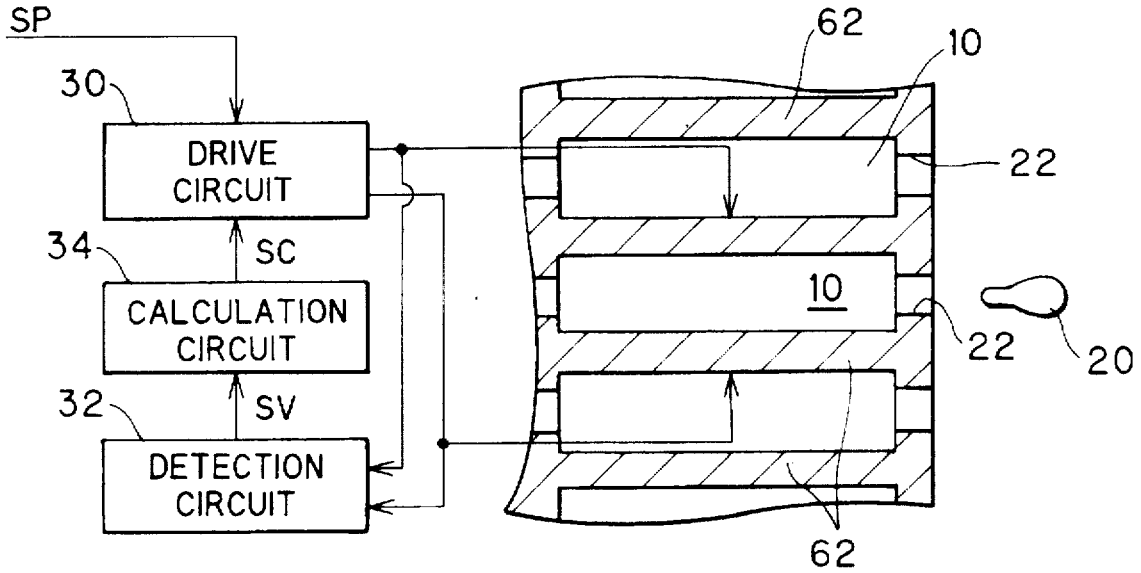
FIG. 9 is a cross-sectional view of a liquid droplet ejecting device according to a third example of the first preferred embodiment.

The following text describes a third example of the first preferred embodiment. As shown in FIG. 9, a printhead is formed from a piezoelectric material, such as PZT piezoelectric transducer, with a plurality of channels formed therein. The channels act as pressure chambers 10. Electrodes are formed to both sides of walls 62 separating the individual pressure chambers 10. The walls 62 function as piezoelectric elements for the pressure chambers 10. Because in this case fluctuations in residual pressure can be detected at both side walls in one pressure chamber 10, the residual pressure can be negated with greater precision. In the liquid droplet ejecting device according to the third example of the first preferred embodiment, the side wall 62 and the detection circuit 32 comprise the residual pressure fluctuation detection means.

In a liquid droplet ejecting device constructed as described in the first preferred embodiment, a residual pressure fluctuation detection means, for example, a piezoelectric element 16 and a detection circuit, detect actual residual pressure fluctuations. A pressure fluctuation compensation means, for example, a calculation circuit 34 and a drive circuit, determine a voltage required to negate the detected residual pressure fluctuations and apply the voltage to a piezoelectric element. Therefore, even if the cycle or the amplitude of residual pressure fluctuations changes by changes in, for example, temperature and other aspects of the ambient environment, or changes in qualities of the liquid to be ejected, residual pressure fluctuations can be accurately reduced. Because of this, even if liquid droplets are ejected at relatively high speeds, residual pressure produces no influence and liquid droplets can be ejected at stable ejection conditions.

A piezoelectric-type liquid droplet ejecting device according to a second preferred embodiment of the present invention relates to liquid droplet ejecting devices for ejecting an ejection liquid from a pressure chamber through a nozzle by changing the internal volume of the pressure chamber by a piezoelectric element. The liquid droplet ejecting device according to the second preferred embodiment includes a measure voltage waveform application means for applying a predetermined voltage waveform to the piezoelectric element, a pressure fluctuation detection means for detecting a pressure wave in the ejection liquid filled pressure chamber caused by the measure voltage waveform application means, a drive waveform calculation means for calculating the special characteristics of the pressure chamber and for calculating the drive voltage waveform for ejecting liquid according to the calculated individual characteristics, a waveform memory means for remembering the drive voltage waveform, and a liquid droplet ejecting means for ejecting liquid droplets using the drive voltage waveform.

Figure 10:
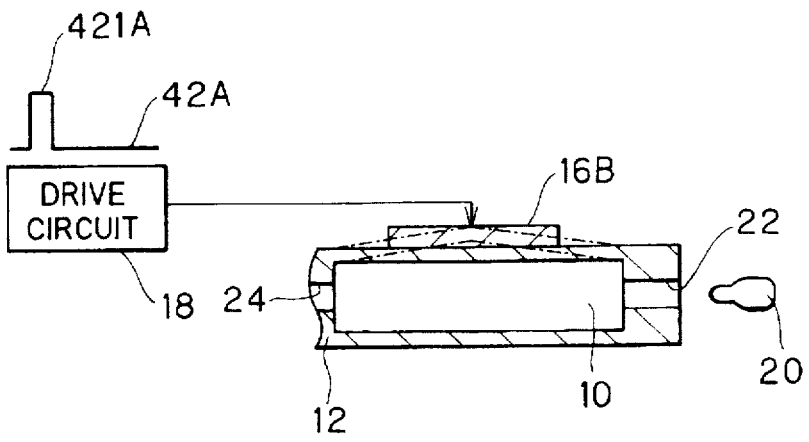
FIG. 10 is a cross-sectional view showing a type of liquid droplet ejecting device.

The second preferred embodiment will be described in regards to the type of piezoelectric-type liquid droplet ejecting device as shown in FIG. 10. Before describing the second preferred embodiment, however, an explanation of this type of piezoelectric-type liquid droplet ejecting device is in order. When a drive voltage 421A in a simple rectangular voltage pulse is applied to the piezoelectric element 16B, the piezoelectric element 16B deforms with the rising edge of the voltage pulse 421A. Consequently, the wall 14 to which piezoelectric element 16A is provided also deforms as indicated by the one-dash chain line in FIG. 10. When the piezoelectric element 16B deforms in this way, the volume of the pressure chamber 10 increases. The increase in volume lowers pressure in the pressure chamber 10. The low pressure suctions ink from the ink supply channel 24 into the pressure chamber 10.

To eject an ink droplet 20, after a predetermined amount of time passes that is sufficient to allow the pressure fluctuations to settle the voltage applied to the piezoelectric element 10 is returned to zero so the piezoelectric element 10 returns to its initial shape before deforming (indicated by the whole line in FIG. 10). The volume of the pressure chamber 10 decreases, causing a corresponding increase in pressure in the pressure chamber 10. The increase in pressure forces an ink droplet 20 through the nozzle 22. This type of liquid droplet ejecting device is often used in ink-jet printers.

With this type of piezoelectric-type liquid droplet ejecting device ejecting ink, as described above, both the decrease in volume of the pressure chamber 10 for suctioning ink into the pressure chamber 10 and the increase in the pressure chamber 10 for ejecting an ink droplet generate a pressure wave. The pressure wave propagates through the pressure chamber 10 via the medium of the ink, reflects off the wall 14, the ink supply channel 24, and the nozzle 22 several times at a reflection rate, attenuating as it proceeds.

Even when ink is ejected using a rectangular drive voltage pulse as in this example, the pressure wave generated when ink is suctioned from the ink supply channel 24 still exists in the pressure chamber 10 when ink is ejected. Because of this, the lowing edge of the drive voltage pulse has to be timed correctly in order to obtain stable effective ink ejection. Also the width of the voltage pulse must be set taking the state of the pressure wave in the pressure chamber 10 into consideration.

Figure 11:
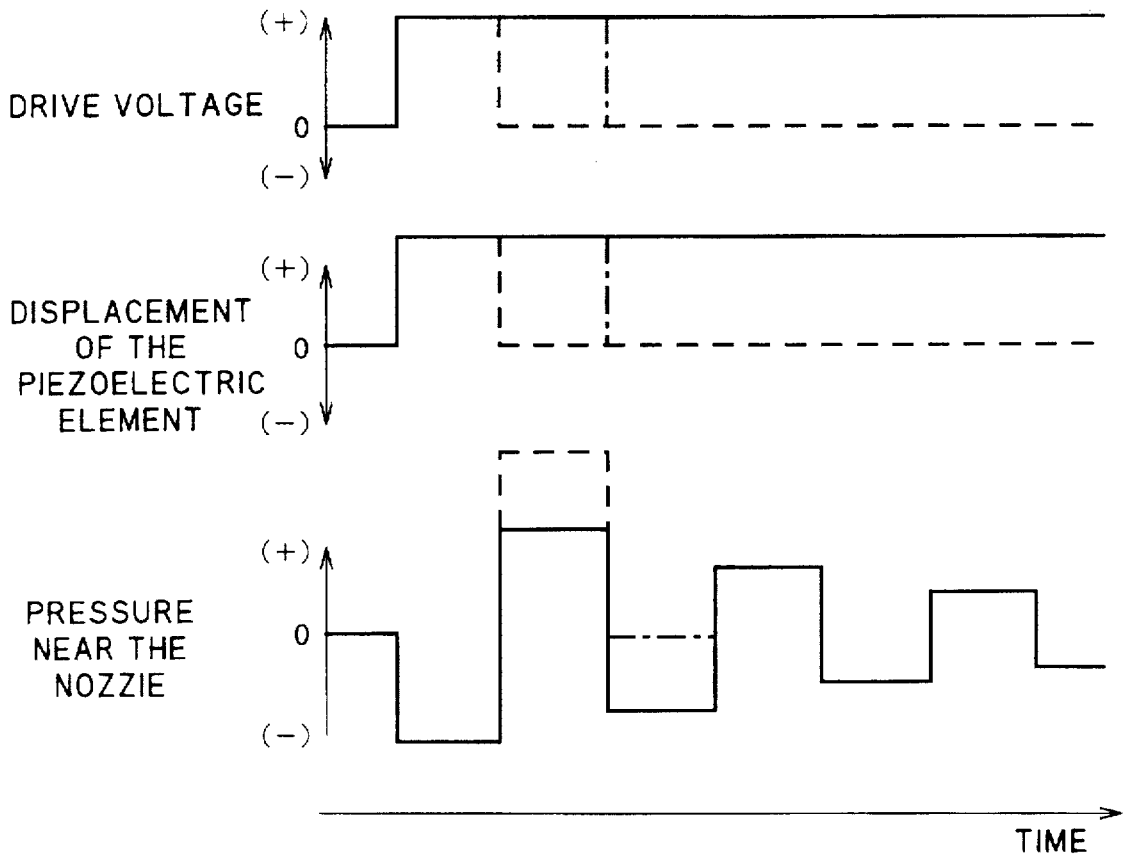
FIG. 11 is a timing showing fluctuations in pressure within a pressure chamber of the liquid droplet ejecting device shown in FIG. 10.

FIG. 11 is a timing chart showing details of pressure fluctuations in the pressure chamber 10 when the rectangular voltage pulse 421A is applied to the piezoelectric element 16A. The solid line in the middle level represents displacement of the piezoelectric element 16A when a voltage pulse is applied. That is, the timing chart simply and briefly shows displacement status of the piezoelectric element 16A, including when ink is suctioned from the ink supply channel 24, and changes in pressure near the nozzle 22.

After the drive voltage has risen as shown by the solid line in FIG. 11, and after the piezoelectric element 16A and the wall 14 have stabilized at the position indicated by the one-dash chain line in FIG. 10, the pressure near the nozzle 22 fluctuates at a set cycle determined by the shape of the pressure chamber 10 and the propagation speed of the pressure wave.

Ink is ejected by returning the drive voltage to zero so the piezoelectric element 16A reverts back to the shape it had before the voltage was applied so the pressure in the pressure chamber 10 increases. However, the fluctuation in pressure affects the amount of pressure produced by returning the drive voltage to zero. For example, if the drive voltage is returned to zero when, as shown by the broken line in the third level of FIG. 11, pressure near the nozzle 22 is high, the pressure produced by the piezoelectric element 16 added to the already existing high pressure will produce a very high ejecting pressure.

Contrarily, if the drive voltage is returned to zero when, as shown by the single-dot chain line in the third level of FIG. 11, the pressure near the nozzle 22 is negative, the pressure produced by the piezoelectric element 16A is negated by the existing low pressure near the nozzle. The resulting pressure will probably be insufficient to eject ink. Even if pressure is sufficient to eject ink, the speed and volume of the ink drop 20 will probably not be at the predetermined speed and volume desired, so that high quality printing is not possible.

The waveform of the voltage drive pulse must be determined with knowledge of the characteristic of the pressure wave in the pressure chamber. The vibration cycle of the pressure is the most important aspect for determining the rectangular voltage pulse. However, when a more complicated wave-type voltage pulse is used, other aspects, such as the phase and the attenuation rate of the pressure vibration, must also be taken into consideration.

The cycle of the pressure wave depends on the propagation speed of the pressure wave in the pressure chamber 10, the shape of the pressure chamber 10, that is, the dimension from the ink supply channel 24 to the nozzle 22, and the like. The attenuation rate of the pressure wave depends on the shape of the nozzle 22. Conventionally, the characteristic of the pressure wave has been determined by calculations or tests.

However, as previously described, the characteristics of the cycle, phase, attenuation rate, and the like of the pressure wave changes according to the qualities of the ink, the ambient environment, and the like. For example, the propagation rate of the pressure wave can be changed by the temperature. Also, the attenuation rate of the pressure wave changes with the qualities of the ink and the amount of air bubbles mixed therein. These changes change the characteristics of the pressure wave. Because of this, it can not be certain that the predetermined drive voltage pulse matches the pressure wave in the pressure chamber 10.

Figure 12:
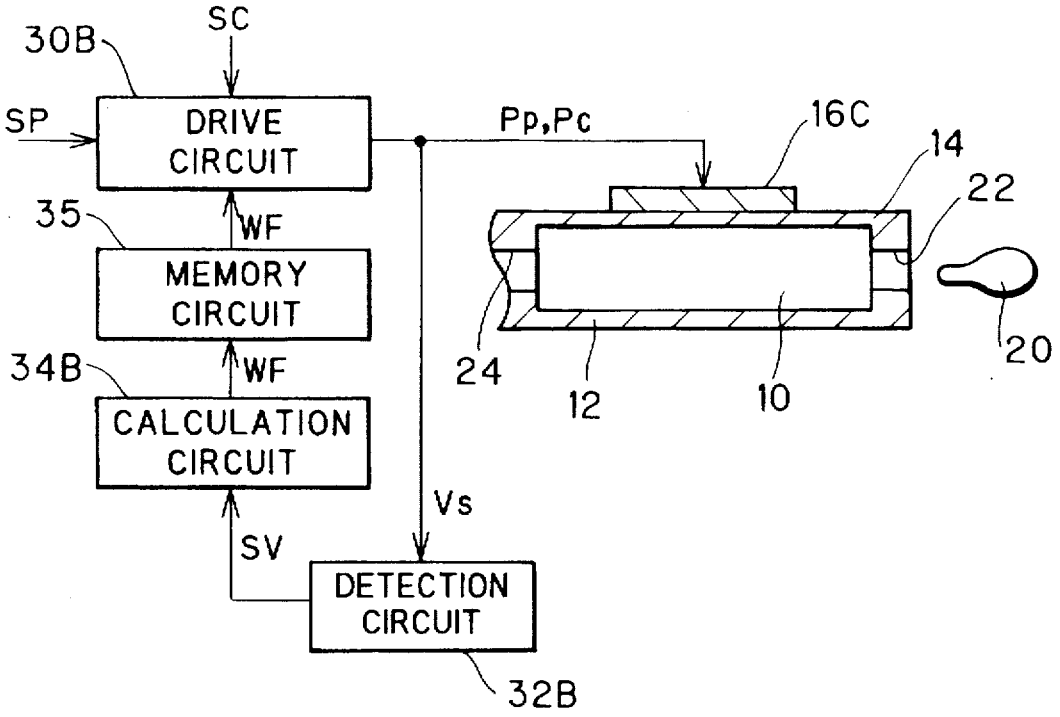
FIG. 12 is a cross-sectional view of a liquid droplet ejecting device according to a first example of a second preferred embodiment.

As shown in FIG. 12, a liquid droplet ejecting apparatus in an ink-jet printer according to a first example of the second preferred embodiment of the present invention includes a drive circuit 30B, a detection circuit 32B, a calculation circuit 34B, and a memory circuit 35. The drive circuit 30B, the detection circuit 32B, and the calculation circuit 34B in the first example of the second preferred embodiment are interconnected similarly to the drive circuit 30, the detection circuit 32, and the calculation circuit 34 in the first example of the first preferred embodiment except that in the first example of the second preferred embodiment the memory circuit is connected between the calculation circuit 34B and the drive circuit 30B for receiving and storing a waveform WF from the calculation circuit 34B and supplying the same to the drive circuit 30B. Also the drive circuit 30B is connected to, for example, a switch on the control panel, for receiving input of a calibration signal SC.

The drive circuit 30B and the detection circuit 32B of the first example of the second preferred embodiment are substantially the same as that of the first preferred embodiment.

Figure 13:
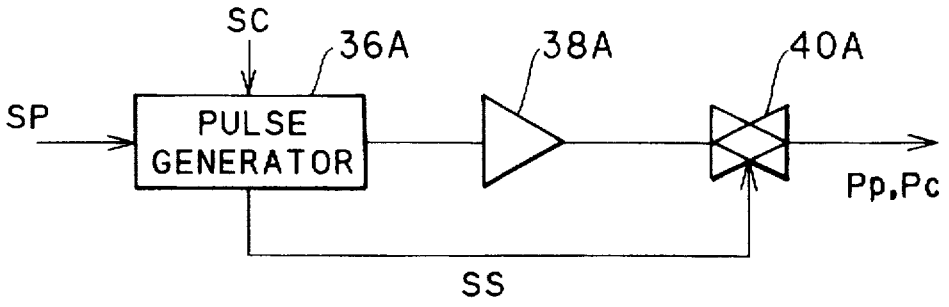
FIG. 13 is a circuit diagram showing components of a drive circuit of the liquid droplet ejecting device shown in FIG. 12.

When normally printing, as shown in FIG. 13, the drive circuit 30B applies a print drive voltage wave PP to the piezoelectric element 16C upon receiving input of a print signal SP. When measuring the special characteristic of the pressure wave, the drive circuit 30B applies a measure drive voltage wave PC to the piezoelectric element 16C upon receiving input of a measure signal SC. The pulse generator 36A outputs a switch signal SS during detection of the pressure wave, which controls the analog switch 40 to electrically disconnect the piezoelectric element 16C from the drive circuit 30B.

The detection circuit 32B is for detecting pressure fluctuations produced after application of the measure drive wave PC by detecting the electric signal VS generated in the piezoelectric element 16C by the pressure fluctuations in the pressure chamber 10. The detection circuit 32B outputs a detection signal SV, to the calculation circuit 34B. The voltage signal VS and the detection signal SV correspond to the average pressure in the pressure chamber 10 during pressure wave measurement.

Figure 14:
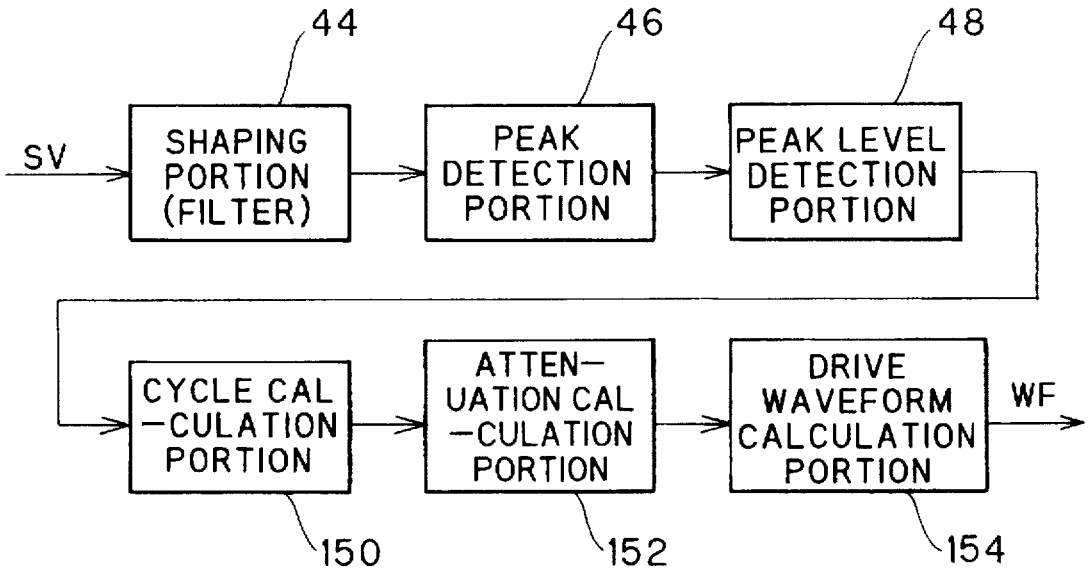
FIG. 14 is a circuit diagram showing components of a calculation circuit of the liquid droplet ejecting device shown in FIG. 12.
Figure 16:
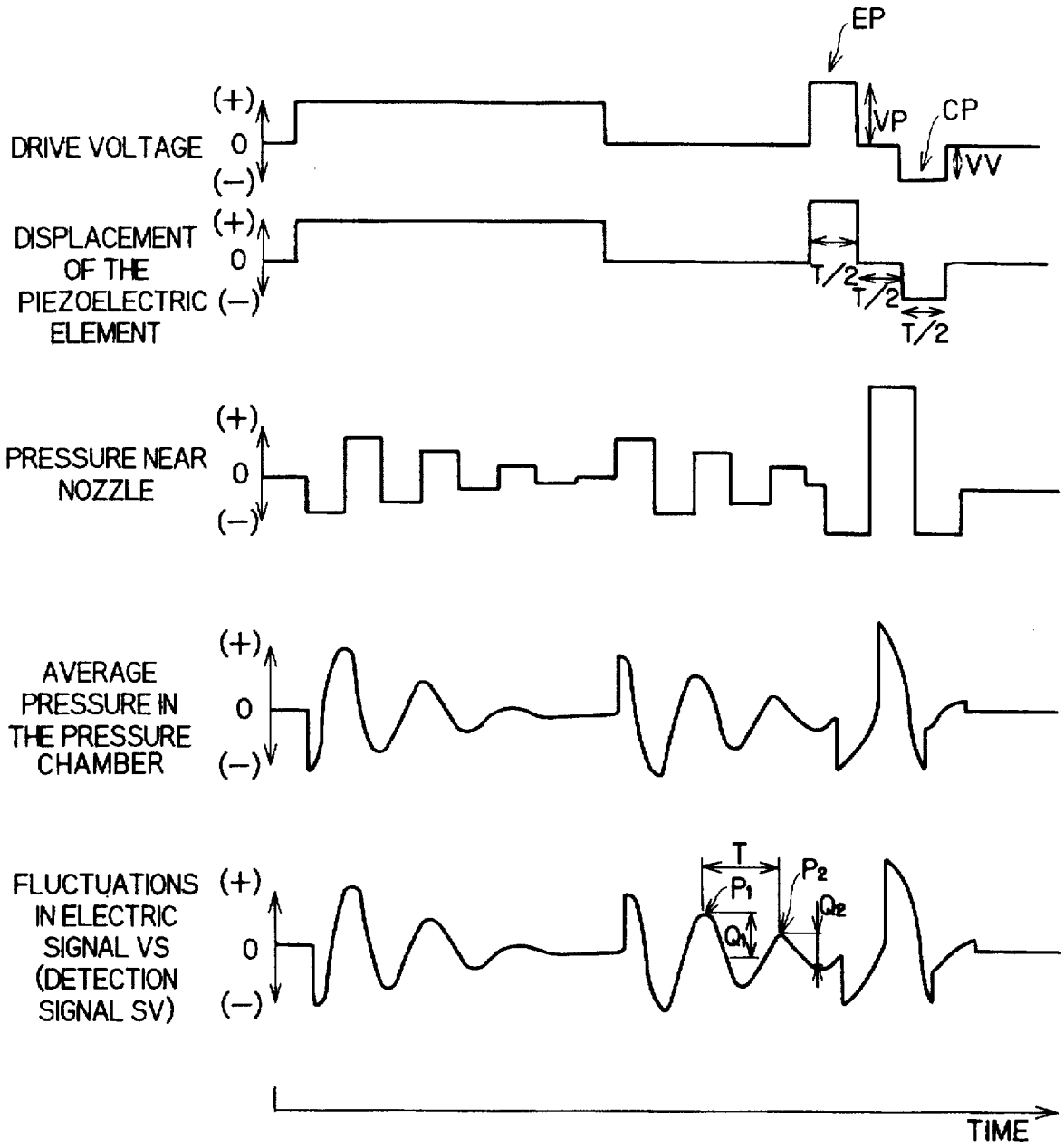
FIG. 16 is a timing chart showing correspondence of fluctuations in pressure within a pressure chamber, and voltage applied to a piezoelectric element, of the liquid droplet ejecting device shown in FIG. 12.

The calculation circuit 34B calculates the characteristics, for example, the cycle and the attenuation rate, of the pressure wave in the pressure chamber 10 based on the detection signal SV. As shown in FIG. 16, the detection signal SV corresponds to the average pressure in the pressure chamber 10. The calculation circuit 34 includes, for example, a microcomputer including, as shown in FIG. 14, a shaping portion (filter) 44, a peak detection portion 46, a peak level detection portion 48, a cycle calculation portion 150, an attenuation rate calculation portion 152, and a drive waveform calculation portion 154. The shaping portion 44 eliminates noise in the detection signal SV by filtering or other methods. The peak detection portion 46 detects peaks P1 and P2 in the detecting signal SV corresponding to pressure fluctuation peaks in the pressure chamber 10. The peak level detection portion 48 detects the voltage value of the detection signal SV in each peak. In this example, the peak level detection portion 48 detects two peak levels Q1 and Q2, wherein peak level Q2 is successive to peak level Q1. However, the peak levels detected could be any two different peak levels. The cycle calculation portion 150 calculates the cycle T from detected peak to detected peak in the detection signal SV. The attenuation rate calculation portion 152 calculates the attenuation rate Q1/Q2 of pressure fluctuation by the change occurring in detection signal SV during the cycle T between detected peaks P1 and P2. The drive waveform calculation portion 154 calculates the voltage and timing of the drive wave using parameters necessary for determining the drive waveform such as the cycle and the attenuation rate of the calculated pressure fluctuation.

Figure 15:
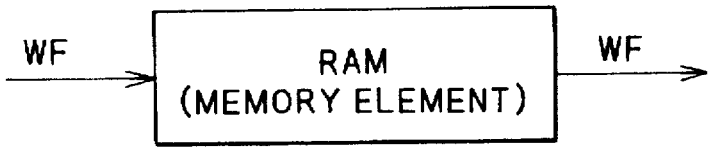
FIG. 15 is a circuit diagram showing components of a memory circuit of the liquid droplet ejecting device shown in FIG. 12.

The drive waveform calculated in the drive waveform calculation portion 154 is stored in the memory circuit 35 as a waveform WF. The memory circuit 35 stores the drive waveform WF using a memory element such as the RAM shown in FIG. 15. The memory circuit 35 outputs the drive waveform WF to the drive circuit 30 during printing operations.

When a calibration signal SC is inputted to the drive circuit 30B, operations are carried out to calibrate the drive waveform WF. The drive waveform for measuring the pressure wave (hereinafter referred to as the measure drive waveform) is applied to the piezoelectric element 16C. In terms of time, as shown in FIG. 16, first, the average pressure in the pressure chamber 10 rapidly increases with the rising edge of the voltage from zero. Afterward, the drive voltage is maintained at a set value. The pressure in the pressure chamber 10 attenuates as it fluctuates. After the pressure fluctuation has sufficiently attenuated, the drive voltage is returned to zero, again generating pressure fluctuations in the pressure chamber 10. At this time, the analog switch 40 shown in FIG. 13 is turned OFF. At the same time, the detection circuit 32B and the calculation circuit 34B operate to determine the drive waveform WF. The drive waveform WF includes an ejection voltage pulse EP and a cancel voltage pulse CP applied as shown in FIG. 16. That is, the ratio between the amplitude VP of the ejection voltage pulse EP and the amplitude VV of the cancel voltage pulse CP is substantially equal to the ratio between the peak level Q1 and the peak level Q2, the ejection voltage pulse EP and the cancel voltage pulse CP are respectively applied for durations substantially equal to the half cycle, and the cancel voltage pulse CP is applied one half cycle of time after the ejection voltage pulse EP.

In this way, in an ink-jet printer with liquid droplet ejecting devices according to the first example of the second embodiment, the actual pressure fluctuation in each pressure chamber 100 is detected using the piezoelectric element 16C and the detection circuit 32B. Because the drive voltage waveform required for actual printing is determined based on the detected pressure wave, even if the cycle or the attenuation rate of the pressure fluctuation in the pressure chamber 10 changes because of changes in the qualities of the ink or in the ambient environment such as temperature, a voltage pulse can be applied at time that meets the pressure fluctuation so that ink droplet 20 can be stably ejected.

Because pressure fluctuation is detected and drive waveforms are calculated separately in all the liquid droplet ejecting devices forming the ink-jet printer in this embodiment, all the devices print at appropriate drive waveforms regardless of differences in each liquid droplet ejecting device.

Figure 17:
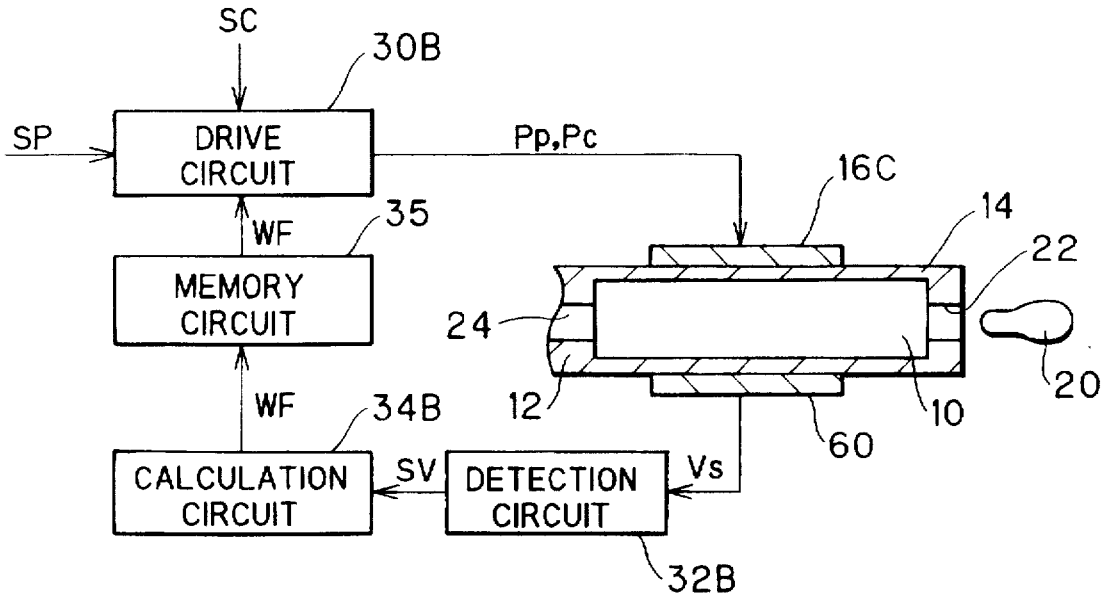
FIG. 17 is a cross-sectional view of a liquid droplet ejecting device according to a second example of the second preferred embodiment.

The following text describes an ink-jet printer with liquid droplet ejecting devices according to a second example of the second preferred embodiment of the present invention. As shown in FIG. 17, the liquid droplet ejecting devices in this example are similar to those in the first example except that a piezoelectric element 60 for detecting pressure in the pressure chamber 10 is provided in addition to the piezoelectric element 16C for driving the ejection operation. The detection piezoelectric element 60 is connected to the input side of the detection circuit 32B. In this example, because the drive circuit 30B and the detection circuit 32B are electrically isolated, pressure fluctuations can be more accurately detected. Also, the analog switch can be omitted.

Figure 18:
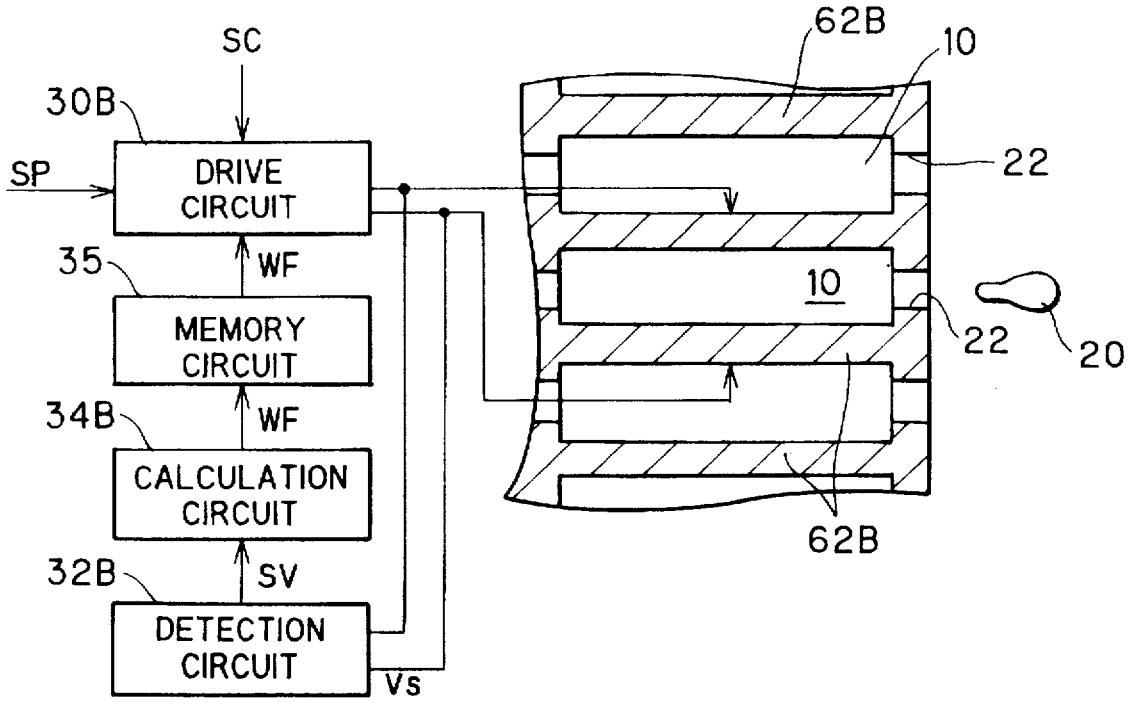
FIG. 18 is a cross-sectional view of a liquid droplet ejecting device according to a third example of the second preferred embodiment.

As shown in FIG. 18, a third example according to the second preferred embodiment relates to an ink-jet printer head made from a piezoelectric material. A plurality of ink channels are formed directly in the piezoelectric material. Each channel forms a pressure chamber 10. Electrodes are formed to both sides of separation walls 62B separating the pressure chambers 10. The separation walls 62B function as piezoelectric elements during droplet ejection operations. In this example, because pressure fluctuations can be detected from both separation walls 62B of one pressure chamber 10, the drive waveform can be calculated with greater precision.

Even in situations where the cycle, attenuation rate, and the like of pressure waves in the pressure chamber change because of changes in the qualities of the liquid to be ejected, or in the ambient environment such as the temperature, the liquid droplet ejecting device according to the second preferred embodiment of the present invention efficiently and stably prints by ejecting a liquid droplet with a set volume and at a predetermined speed because ejection voltage pulses are applied to the piezoelectric element at a time which matches a suitable pressure level in the pressure fluctuation.

Although, methods for compensating for residual pressure fluctuations in the pressure chamber were described in the first preferred embodiment for a liquid droplet ejecting device which ejects droplets when a voltage pulse is applied to the piezoelectric element and in the second preferred embodiment for a liquid droplet ejecting device which ejects droplets when a voltage pulse applied to the piezoelectric element is turned off, these calculation methods should not be interpreted as limited to the referred types of liquid droplet ejecting devices. The method of calculating a compensation voltage pulse described in the first preferred embodiment can be applied to the type of liquid droplet ejecting device described in the second preferred embodiment, and vice versa.

Figure 19:
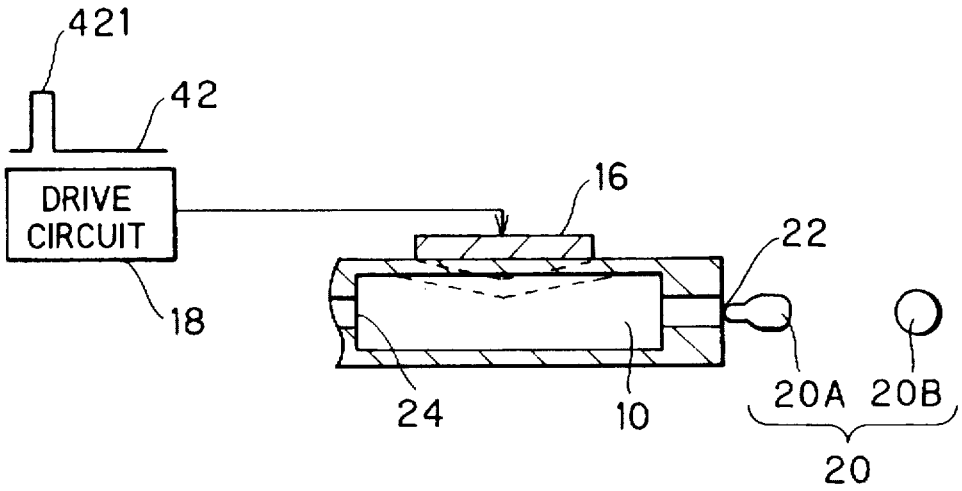
FIG. 19 is a cross-sectional view showing a type of liquid droplet ejecting device.

The present invention has been described above for use in a liquid droplet ejecting device wherein, as shown in FIG. 19, the voltage applied by a drive circuit 30 to the piezoelectric element 16 for ejecting a single droplet 20B is in the simplest possible waveform 42, that is, with only a single drive voltage pulse 421. For an extremely brief time directly after the pressure increase in the pressure chamber 10 pushes the ink 20 through the nozzle 22, the ink 20A remains connected to the tip of the nozzle 22. However, as the inertia of the ejected ink 20 moves the ink 20 forward, the connection breaks and the ink 20 forms a droplet 20B.

Tonal printing can be performed using a single voltage pulse driven by, for example, adjusting the level or the pulse width of the drive voltage to increase or decrease the volume of ink in each droplet. However, with this method ink drops with large volumes are inevitably slower than those with lower volumes. This method also tends to form satellites, that is, unwanted smaller droplets in addition to the desired droplet. In both cases quality of printed characters is adversely affected. Also, great changes in the volume of the ink droplets are actually impossible using the single voltage pulse drive method.

Figure 20:
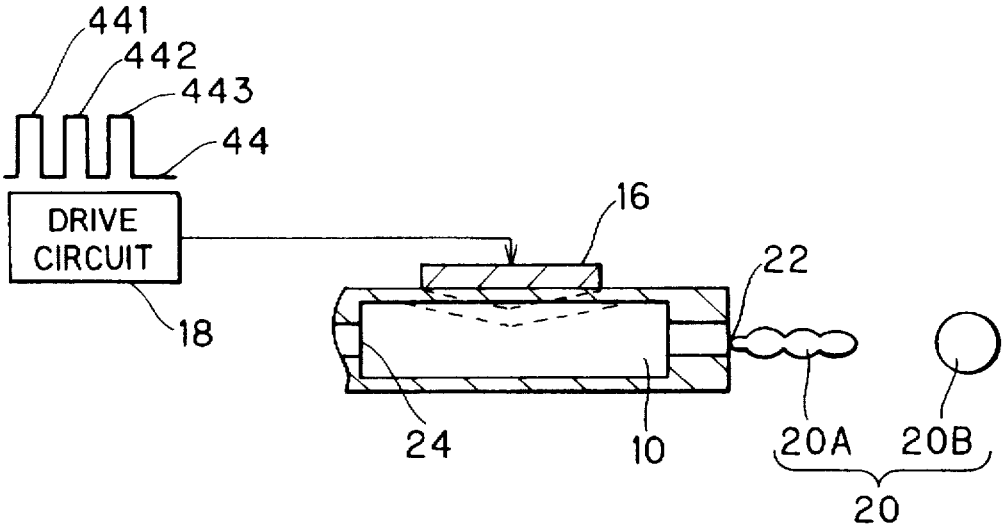
FIG. 20 is a cross-sectional view showing a multipulse-type liquid droplet ejecting device.

As shown in FIG. 20, there has been known a multipulse drive method for ejecting ink droplets in a broad range of volumes. With this method, drive voltage output from the drive circuit 18 to the piezoelectric element 16 is in a waveform 44 including a plurality, three in this example, of voltage pulses 441, 442, and 443. The second drive voltage pulse 442 is applied to the piezoelectric element 16 while the ink droplet 20A ejected by application of a leading first voltage pulse 441 is still connected to the nozzle 22. A third drive voltage pulse 443 and further drive voltage pulses can be similarly consecutively applied to the piezoelectric element 16B while the ink droplet ejected by application of the proceeding drive voltage pulse is still connected to the nozzle to provide an ink droplet 20B with a desired volume.

However, with this multi-pulse drive method residual pressure fluctuations are also generated in the pressure chamber 10 after ink 20 is discharged by the lead drive voltage pulse 441. Therefore, when the second drive voltage pulse 442 is applied to the piezoelectric element 16, the amount and speed of the ink changes depending on the phase of the residual voltage fluctuation. In particular, when the phase of the residual pressure fluctuation and the phase of the drive voltage pulse are opposite or near opposite, sometimes no ink will be ejected by the second drive voltage pulse. In the same way, when a third drive voltage pulse 443 or ensuing drive voltage pulse is applied to the piezoelectric element 16, the ejected droplet 20B is affected by residual pressure fluctuation from both the first drive voltage pulse, the second drive voltage pulse, and other preceding drive voltage pulses.

Conventionally the cycle, phase, and attenuation rate of residual pressure fluctuations generated by the first and successive voltage pulses in the multi-pulse drive method have been measured or calculated beforehand to determine the time of application of successive drive voltage pulses. However, the cycle, phase, and attenuation rate characteristics of residual pressure fluctuations vary with such factors as the dimensions of the pressure chamber, the qualities of the ink, and the ambient environment. Therefore, actual residual pressure fluctuations do not always match residual pressure fluctuations determined by calculations or tests. Because of this problem, ejection of ink in predetermined volumes has been impossible with the conventional multi-pulse drive method because the phases of the residual pressure fluctuations and the drive voltage pulses do not always match.

A liquid droplet ejecting device according to a third preferred embodiment of the second invention relates to a multi-pulse type liquid droplet ejecting device wherein liquid is ejected successively in small quantities from a pressure chamber to form a single larger liquid droplet. This is accomplished by a drive means successively applying a plurality of drive voltage pulse signals to a piezoelectric element to deform the piezoelectric element the same number of times as the number of drive voltage pulse signals. The liquid droplet ejecting device according to the third preferred embodiment is improved over conventional liquid droplet ejecting devices of this type by the inclusion of a detection means for detecting pressure fluctuations in the ink within the pressure chamber caused by each predetermined voltage pulse of the drive voltage pulse signal and a control means for controlling the drive means to generate voltage pulses successive to the predetermined voltage pulse based on the actual pressure fluctuation detected by the detection means.

Figure 21:
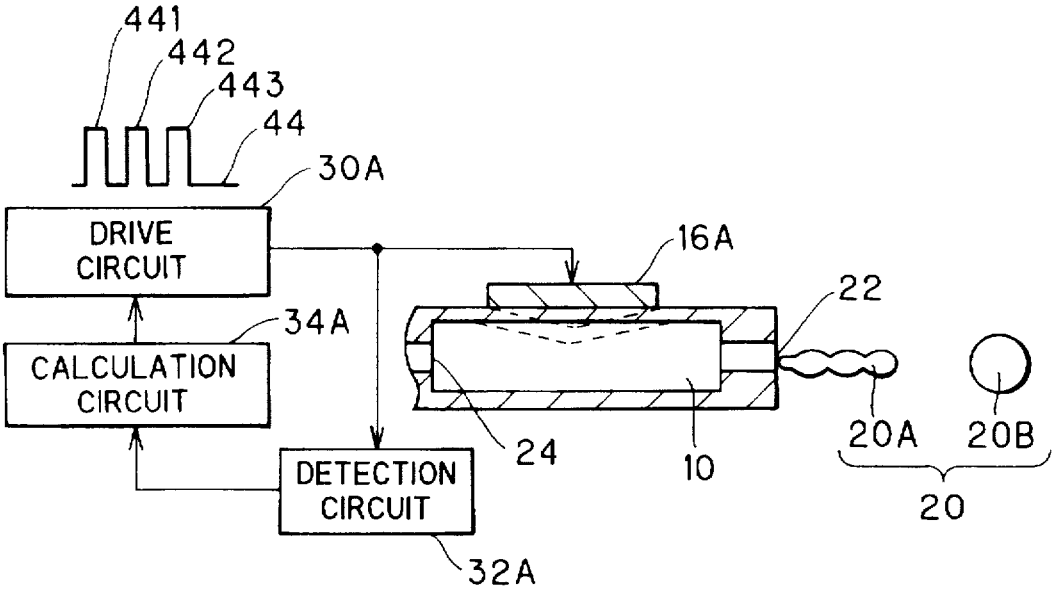
FIG. 21 is a cross-sectional view showing a multipulse-type liquid droplet ejecting device according to a first example of a third preferred embodiment.
Figure 22:
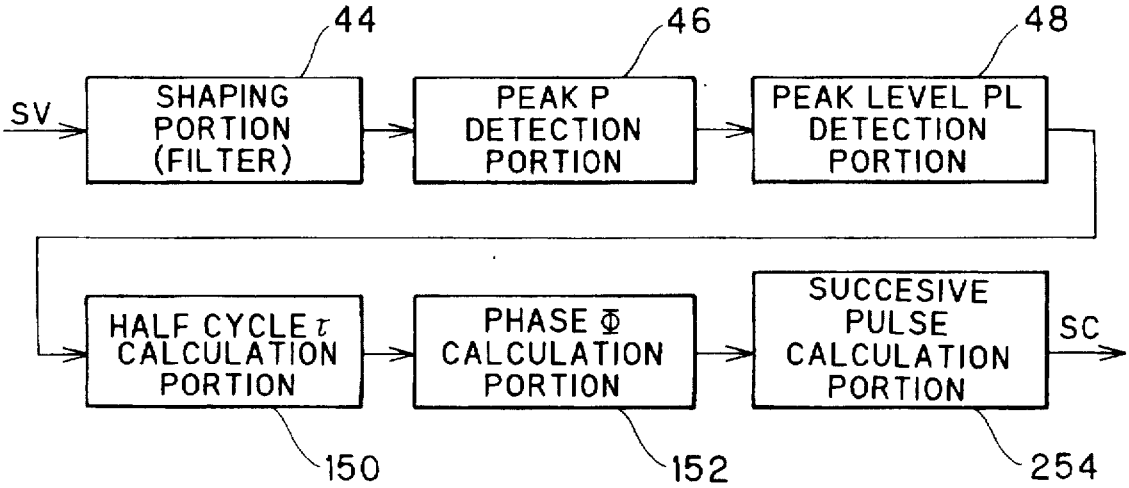
FIG. 22 is a circuit diagram showing components of a calculation circuit of the liquid droplet ejecting device shown in FIG. 21.

While referring to FIG. 21, the following text describes a first example of a multi-pulse piezoelectric-type liquid droplet ejecting device according to the third preferred embodiment. The structure of this multi-pulse piezoelectric-type liquid droplet ejecting device is similar to conventional multi-pulse types but has added thereto a detection circuit 32A and a calculation circuit 34A. The detection circuit 32A is substantially the same as described in the first preferred embodiment and detects residual pressure fluctuations in the pressure chamber 10 with every predetermined voltage pulse 441 of the multi-pulse drive signal 44 generated by the drive circuit 30A. As shown in FIG. 22, the calculation circuit 34A is similar to that described in the first preferred embodiment, but with a successive voltage pulse calculation portion 254 instead of the cancel voltage pulse PC calculation portion 54. The successive voltage pulse calculation portion 254 calculates the voltage and time of application of the successive voltage pulse based on the cycle and the phase of the calculated pressure fluctuation. The calculation circuit 34A calculates, based on the residual pressure fluctuations detected by the detection circuit 32A, an appropriate pulse width and time for applying successive drive voltage pulses 442 and 443 of the multi-pulse drive signal 44 from the drive circuit 30A and controls the drive circuit 30A based on the results of the calculations.

Figure 23:
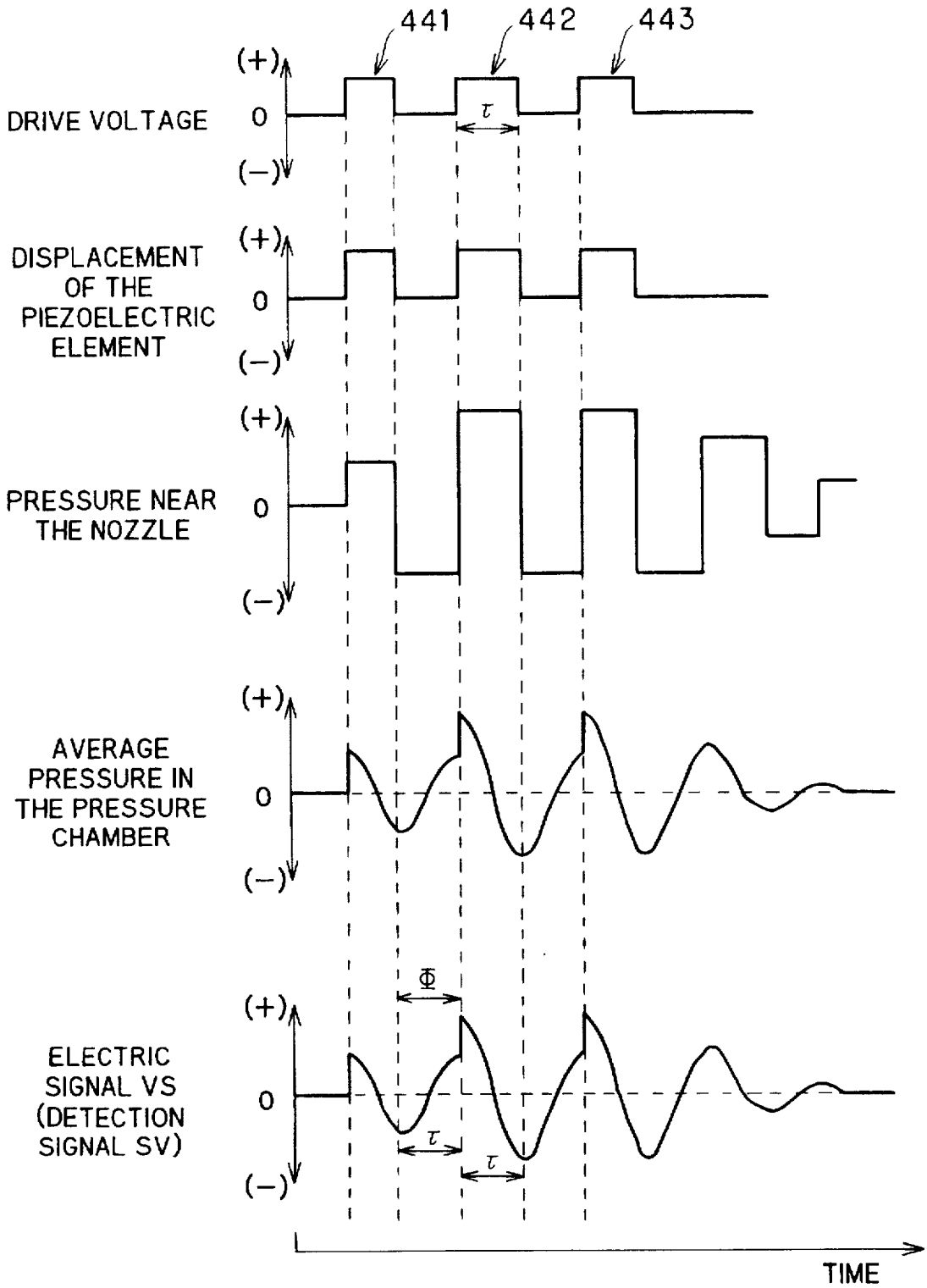
FIG. 23 is a timing chart showing an example of correspondence of fluctuations in pressure within a pressure chamber, and voltage applied to a piezoelectric element, of the liquid droplet ejecting device shown in FIG. 21.

The following is an explanation of operations in the ink ejection device according to a first example of the third preferred embodiment. When the drive circuit 30A applies a first drive voltage pulse 441 having a predetermined voltage and width to the piezoelectric element 16A, the piezoelectric element 16A deforms as shown by the dotted line in FIG. 21. This causes the pressure in the pressure chamber 10 to increase so that ink is ejected from the nozzle 22. Afterward, the piezoelectric element 16A reverts to the shape it had before liquid droplet ejection and the pressure within the pressure chamber 10 also temporarily returns to the pressure of before liquid droplet ejection. However, residual pressure fluctuation, generated in the pressure chamber 10 by the pressure of the ejection operation, causes the pressure in the pressure chamber 10 to increase and decrease. The residual pressure fluctuation in the pressure chamber 10 deforms the piezoelectric element, which generates a voltage accordingly from the piezoelectric effect. Upon detecting the lowering edge of the first voltage pulse, the pulse generator 36 outputs the switch signal SS to the analog switch 40, thereby electrically isolating the piezoelectric element 16 from the drive circuit 30, the detection circuit 32A detects the voltage generated by the piezoelectric element 16A in accordance with the pressure fluctuations in the pressure chamber 10 and transmits the detected pressure value to the calculation circuit 34A. The calculation circuit 34A calculates width, time of application, height, and the like of a second drive voltage pulse 442 according to the detected pressure fluctuations. The pulse width, time of application, and the like calculated by the calculation circuit 34A depends on the type of droplet desired to be produced by the second drive voltage pulse 442. For example, an extremely large droplet might be desirable, in which case the second drive voltage pulse 442 would be timed to be applied while pressure in the pressure chamber 10, caused by residual pressure fluctuations, is high as shown in FIG. 23. However, when the voltage pulse is applied and its width might also be adjusted according to the conditions in the pressure chamber 10 so that droplets are of a uniform size at all ejections. The calculation circuit 34A outputs the calculated pulse width and time of application to the drive circuit 30A in the form of a second drive signal 442 for ejecting the successive droplet. The drive circuit 30A applies the second drive voltage pulse 442 to the piezoelectric element 16A for ejecting the successive droplet. Afterward, the detection circuit 32A detects the pressure fluctuation in the pressure chamber 10 caused by ejection of the second droplet, the calculation circuit 34A calculates the width and time of application of the successive drive voltage pulse 443, and the drive circuit 30A applies drive voltage pulse 443 to the piezoelectric element 16A accordingly. As shown in FIG. 21, directly after being ejected, the three droplets 20A ejected from the pressure chamber 10 by the first, second, and third drive voltage pulses 441, 442, and 443 are connected to each other and to the nozzle. Shortly thereafter, the three droplets separate from the nozzle 22 and form a single large droplet 20B.

Figure 24:
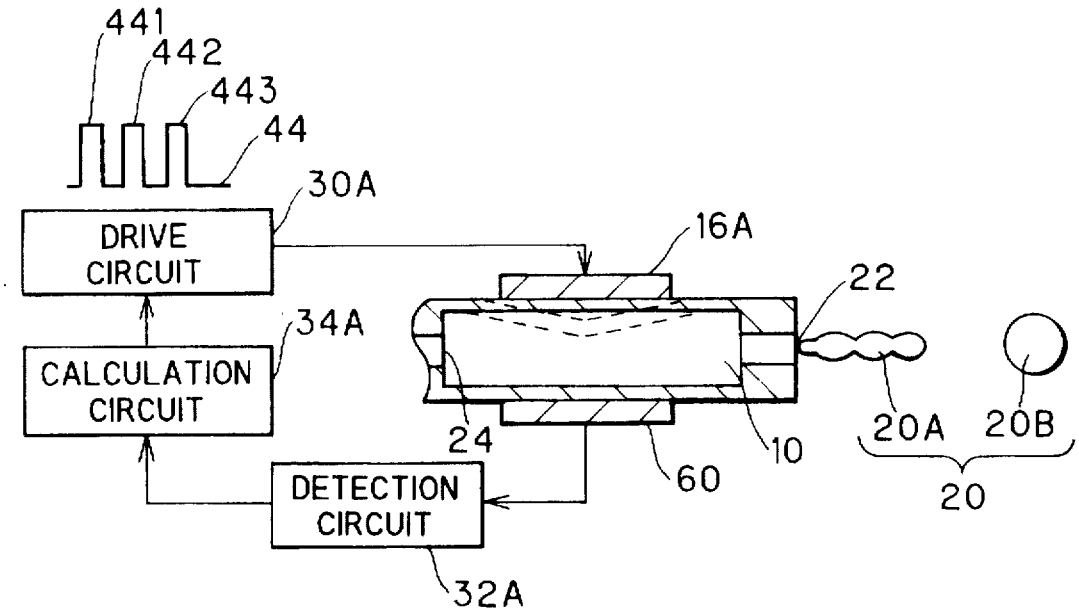
FIG. 24 is a cross-sectional view of a liquid droplet ejecting device according to a second example of the third preferred embodiment.

The first example of the third preferred embodiment describes the same piezoelectric element 16A employed as a pressure sensor and as a droplet ejection means. However, as shown in FIG. 24, in a second example of the third preferred embodiment two piezoelectric elements, a pressure fluctuation detection piezoelectric element 60 and an ejection piezoelectric element 16A, are provided on either side of the pressure chamber 10. In this case, because the detection circuit 32A and the drive circuit 30A are electrically isolated, the detection circuit 32A is unaffected by the drive circuit 30A and so more accurately measures residual pressure fluctuations. Also, the analog switch is unnecessary.

Figure 25:
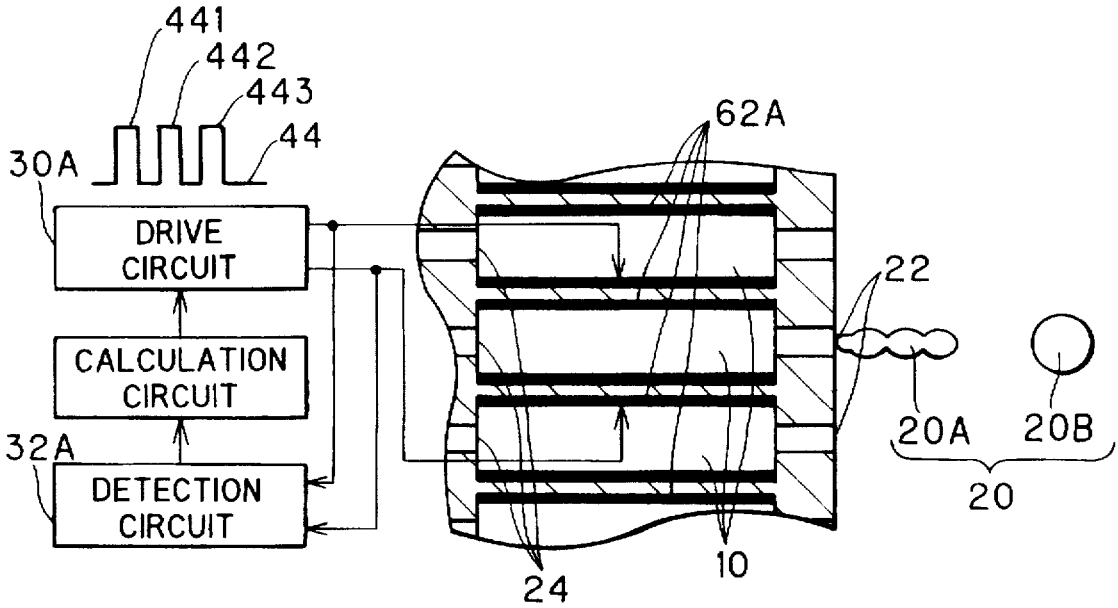
FIG. 25 is a cross-sectional view of a liquid droplet ejecting device according to a third example of the third preferred embodiment.

As shown in FIG. 25, in a third example of the third preferred embodiment, a plurality of channels are formed in a piezoelectric ceramic material. The channels act as pressure chambers 10 and the walls 62A act as piezoelectric elements. Drive voltage pulses from the drive circuit 30A are applied directly to the walls 62A of the pressure chambers 10. Because two walls 62A of each pressure chamber 10 generate electric signals corresponding to residual pressure fluctuation in the pressure chamber 10, residual pressure fluctuation can be more accurately measured.

A liquid droplet ejecting device constructed as described in the third preferred embodiment relates to a multi-pulse type liquid droplet ejecting device for ejecting liquid from a pressure chamber in small quantities at a time to form a single larger liquid droplet by successively applying from a drive means to a piezoelectric element a plurality of drive voltage pulse signals to deform the piezoelectric element the same number of times as the number of drive voltage pulse signals. The multi-pulse type liquid droplet ejecting device according to the third preferred embodiment includes a detection means for detecting pressure fluctuations in the liquid droplet ejecting device with every predetermined voltage pulse of the drive voltage pulse signal and a control means for controlling the drive means to generate successive voltage pulses (after the predetermined voltage pulse) based on the detected results of the detection means. Therefore, droplet ejection is unaffected by changes in qualities of the ink or changes in the ambient environment, thereby allowing optimum printing.

While the invention has been described in detail with reference to specific embodiments thereof, it would be apparent to those skilled in the art that various changes and modifications may be made therein without departing from the spirit of the invention.

For example, the preferred embodiments describe residual pressure fluctuations measured for each ejection operation and a successive compensation voltage pulse calculated accordingly. For example, in the first preferred embodiment, residual pressure fluctuations were measured after each ejection of an ink droplet and a cancel voltage pulse PC outputted accordingly; in the second preferred embodiment, one series of operations from detection of the residual pressure fluctuations caused by each initial predetermined voltage pulse to calculation of drive waveform were performed for each ejection operation; and in the third preferred embodiment, residual pressure fluctuations were measured after every droplet ejection. However, residual pressure fluctuations could be detected, for example, by a test measurement, only at a predetermined sampling time, such as when an optional switch is manipulated, after a predetermined period of time passes, or directly after the printer power is turned ON. Actual drive voltage pulses can be timed based on this test measurement until the following test measurement is taken. This allows high-speed printing even if the detection circuit and the calculation circuit are not high speed components.

For example, in the first preferred embodiment the calculated cancel voltage pulse PC and the phase $\phi$ could be stored in a memory and used to create cancel voltage pulses for each successive ejection of a droplet until an ensuing sampling time when residual pressure fluctuations in the pressure chamber 10 are again detected and a new cancel voltage pulse PC and phase $\phi$ are calculated. If sampling is performed before actual printing begins, there is no necessity to rapidly produce the cancel voltage pulse PC and negate the residual pressure before a successive ink ejection. Therefore, there is extra time to more precisely calculate the cancel voltage pulse PC and the phase $\phi$, expensive high-speed circuitry need not be used, and the half cycle $\tau$ of the total amplitude characteristic of the residual pressure fluctuation can be detected with greater precision.

Also, a test drive voltage applied to the piezoelectric element before actual printing begins can be at a voltage lower than actually needed to eject an ink droplet. This is because the strength of the drive voltage affects the peak level of the residual pressure fluctuation, but not other qualities thereof such as its phase or half cycle. For example, in the first preferred embodiment, by applying a test drive pulse voltage with a known voltage, and then detecting the peak level PL in the resultant residual pressure fluctuation, a cancel voltage VC sufficient for negating residual pressure fluctuations brought about by a print voltage pulse PP with a known drive voltage can be determined from the relationship between the test drive voltage and the peak level PL of the resultant residual pressure fluctuation. Also, in the second preferred embodiment, the attenuation rate of the pressure wave can be calculated even if the voltage creates pressure fluctuation with peaks lower than during actual ink ejection.

Further, although the preferred embodiments describe each liquid droplet ejecting device formed in the ink-jet printer as including an individual detection circuit and calculation circuit, and, in the second preferred embodiment, a memory circuit, these circuits need only be supplied to one or one portion of the liquid droplet ejecting devices. That is, measurements need not be performed at every pressure chamber. Only the residual pressure fluctuation in one pressure chamber or one group of pressure chambers need be measured to provide information representative of the others. The pressure determined at the selected pressure chambers can be used for producing drive voltage pulses for driving all the pressure chambers. For example, in the first preferred embodiment, the required cancel voltage pulse PC, the phase $\phi$, or the like determined by the liquid droplet ejecting device or devices including circuits can be used as the cancel voltage pulse PC, the phase $\phi$, and the like of the other liquid droplet ejecting devices.

Also, the representative pressure chamber or chambers can be dummy pressure chambers, not actually used for ejection but with the same physical properties as the real pressure chambers. The drive voltage and the like determined at the dummy liquid droplet ejecting devices can be used in the liquid droplet ejecting devices which actually print.

Still further, pressure fluctuations in the pressure chambers are transmitted, although in a rather attenuated form, through the ink supply channel to an ink tank. Therefore, if the pressure propagation characteristic of the ink supply channel is known, the characteristic of the pressure chamber and the residual pressure fluctuations in the ink in pressure chambers can be calculated by measuring pressure fluctuations in the ink in the ink tank.

All the preferred embodiments describe measuring specific portions of the residual fluctuation to determine the voltage of and application time of a compensation voltage pulse. However these are only examples. For example, although the first preferred embodiment describes detecting the first positive pressure peak PL of the residual pressure fluctuation and determining and outputting a cancel voltage pulse PC for negating the pressure at the first positive pressure peak PL, the cancel voltage pulse PC could be determined according to the second or ensuing positive peaks or according to the first, second or ensuing negative pressure peaks. Similarly, in the first preferred embodiment, when the cancel voltage pulse, the phase $\phi$, and the like are determined by a test drive voltage pulse, the cancel voltage pulse can be output by detection of the first negative pressure peak. However, the negative pressure peak can only be detected when the phase $\phi$ is less than the half cycle $\tau$. Changes in temperature change the relative duration of the phase $\phi$ and the half cycle $\tau$ so that sometimes the phase $\phi$ is greater than the half cycle $\tau$.

The circuit structures and functions of the components shown in the diagrams are only examples which can be modified as appropriate to meet special requirements. For example, in the first preferred embodiment, when the half cycle $\tau$ and the phase $\phi$ are substantially the same because of the pulse width of the print voltage pulse PP, the phase $\phi$ calculation portion 52 can be eliminated by assuming the half cycle $\tau$ and the phase $\phi$ to be equal ($\phi=\tau$). In this case, methods for determining when the cancellation voltage pulse PC is applied and setting the pulse width can be modified.

The preferred embodiments describe the calculation circuit determining a compensation voltage pulse. However, a compensation voltage pulse could be initially set with a predetermined amplitude, voltage, and time lag at which it is to be applied and then corrected by the calculation circuit according to the residual pressure fluctuations detected by the detection circuit. For example, in the first preferred embodiment, the cancel voltage pulse could be initially set with a predetermined amplitude, voltage, and time lag at which it is to be applied after application of the print voltage pulse PP stops. The predetermined cancel voltage pulse would then be corrected based on the actual phase, amplitude, cycle, and the like of the residual pressure fluctuation detected by the detection circuit.

Also, droplet ejection devices described in the second example of each preferred embodiment, wherein a separate piezoelectric element is used for detecting residual pressure fluctuations, can be feedback controlled. In this case, the detection piezoelectric element detects residual pressure fluctuations while the compensation voltage pulse is sequentially calculated and outputted to the drive piezoelectric element. For example, in the second example of the first preferred embodiment, the detection piezoelectric element detects residual pressure fluctuations while the cancel voltage required for negating the detected residual pressure is sequentially calculated and outputted to the piezoelectric element, thereby reducing the residual pressure to zero. This type of feedback control can also be applied to the liquid droplet ejecting device described in the third example of the preferred embodiments. For example, in the second preferred embodiment, after a print voltage pulse PP is applied to both side walls of a pressure chamber, resultant residual pressure fluctuation is detected at one of the side walls and the cancel voltage determined using the detection residual pressure is applied to the other side wall, thereby negating the detected residual pressure.

What is claimed is:

1. A piezoelectric-type liquid droplet ejecting device for ejecting a liquid droplet from a pressure chamber to print a dot during a printing operation, the pressure chamber having an internal volume defined by a plurality of walls for containing the liquid, comprising;

a piezoelectric element associated with at least one wall of the plurality of walls for changing the internal volume of the pressure chamber by deforming the at least one wall of the plurality of walls in response to application of electric voltage;

drive means for applying a predetermined voltage pulse to the piezoelectric element;

piezoelectric residual pressure fluctuation detection means for detecting, during a continuation of the printing operation following the print of the dot, residual pressure fluctuation, the residual pressure fluctuation being generated in the pressure chamber by the application of the predetermined voltage pulse with a predetermined parameter to the piezoelectric element, the piezoelectric element deforming upon application of the predetermined voltage pulse; and residual pressure fluctuation compensating means, for determining a compensation voltage pulse based on the residual pressure fluctuation detected by the residual pressure fluctuation detection means and for applying the compensation voltage pulse to the piezoelectric element, the compensation voltage pulse deforming the piezoelectric element upon application thereto to compensate for residual pressure fluctuation in the pressure chamber.

2. A piezoelectric-type liquid droplet ejecting device as claimed in claim 1, wherein the residual pressure fluctuation detection means includes a detection element for generating an electric signal corresponding to residual pressure fluctuations in the pressure chamber, and a detection circuit connected to the detection element for receiving the electric signal and supplying a detection signal corresponding to the electric signal to the residual pressure fluctuation compensating means, and wherein the residual pressure fluctuation compensation means includes a calculation circuit for calculating the compensation voltage pulse based on residual pressure fluctuations as detected by the detection means, and said drive means is a drive circuit for applying the compensation voltage pulse to the piezoelectric element.

3. A piezoelectric-type liquid droplet ejecting device as claimed in claim 2, wherein the calculation circuit determines voltage, duration, and time of application of the compensation voltage pulse as required for negating the residual pressure fluctuation in the pressure chamber.

4. A piezoelectric-type liquid droplet ejecting device as claimed in claim 3, wherein the drive circuit applies the compensation voltage pulse calculated in the calculation circuit to the piezoelectric element after application of an ejection voltage pulse, the ejection voltage pulse being of sufficient voltage and duration for causing the piezoelectric element to deform sufficiently to eject a liquid droplet from the pressure chamber.

5. A piezoelectric-type liquid droplet ejecting device as claimed in claim 4, wherein the calculation circuit includes:

peak detection means for detecting a peak in the electric signal;

peak level detection means for detecting a level of the peak;

half cycle calculation means for calculating a half cycle of the electric signal;

phase calculation means for calculating a phase based on the predetermined voltage pulse and the peak electric signal; and compensation voltage pulse calculation means for calculating the voltage of the compensation voltage pulse based on the level of the peak, the pulse width of the compensation voltage pulse based on the half cycle, and the application time of the compensation voltage pulse based on the phase.

6. A piezoelectric-type liquid droplet ejecting device as claimed in claim 5, wherein the detection element includes the piezoelectric element, the piezoelectric element being deformed by residual pressure fluctuations in the pressure chamber, the piezoelectric element generating the electric signal by the piezoelectric electric effect corresponding to the residual pressure fluctuations, the piezoelectric element supplying the electric signal to the detection circuit, and wherein the drive circuit selectively applies the compensation voltage pulse and the ejection voltage pulse to the piezoelectric element.

7. A piezoelectric-type liquid droplet ejecting device as claimed in claim 6, wherein the drive circuit includes isolation means for electrically isolating the drive circuit from the piezoelectric element during detection of residual pressure fluctuation in the pressure chamber.

8. A piezoelectric-type liquid droplet ejecting device as claimed in claim 5, wherein the detection element includes another piezoelectric element, the another piezoelectric element being deformed by residual pressure fluctuations in the pressure chamber, the another piezoelectric element generating the electric signal by the piezoelectric electric effect corresponding to the residual pressure fluctuations, the another piezoelectric element supplying the electric signal to the detection circuit, and wherein the drive circuit selectively applies the ejection voltage pulse and the compensation voltage pulse to the piezoelectric element.

9. A piezoelectric-type liquid droplet ejecting device as claimed in claim 8, wherein the predetermined voltage pulse is of sufficient voltage and duration for causing the piezoelectric element to deform sufficiently to eject a liquid droplet from the pressure chamber.

10. A piezoelectric-type liquid droplet ejecting device as claimed in claim 2, further comprising:

predetermined voltage pulse application means for applying the predetermined voltage pulse to the piezoelectric element; and memory means for storing a waveform of the compensation voltage pulse calculated in the calculation circuit and for supplying the compensation voltage pulse to the drive circuit.

11. A piezoelectric-type liquid droplet ejecting device as claimed in claim 10, wherein the compensation voltage pulse includes a combination of:

an ejection voltage pulse being of sufficient voltage and duration for causing the piezoelectric element to deform sufficiently to eject a liquid droplet from the pressure chamber; and a cancel voltage pulse being of sufficient voltage and duration for negating residual pressure fluctuation upon being applied to the piezoelectric element, the residual pressure fluctuation being generated in the pressure chamber by application of the ejection voltage pulse to the piezoelectric element.

12. A piezoelectric-type liquid droplet ejecting device as claimed in claim 11, wherein the calculation circuit includes:

peak detection means for detecting a peak and an ensuing peak in the electric signal;

peak level detection means for detecting peak level of the peak, and the ensuing peak level of the ensuing peak;

cycle calculation means for calculating a cycle of the electric signal corresponding to the time duration between when the peak level is detected and when the ensuing peak level is detected;

attenuation calculation means for calculating attenuation rate based on the ratio of the peak level and the ensuing peak level; and compensation voltage pulse waveform calculation means for calculating the waveform of the compensation voltage pulse so that an amplitude of the ejection voltage pulse and an amplitude of the cancel voltage pulse are at a ratio substantially equal to the ratio of the peak level and the ensuing peak level, so that the ejection voltage pulse and the cancel voltage pulse are respectively applied at durations substantially equal to the cycle, and so that the cancel voltage pulse is applied substantially one cycle after completion of application of the ejection voltage pulse.

13. A piezoelectric-type liquid droplet ejecting device as claimed in claim 12 wherein the detection element includes the piezoelectric element, the piezoelectric element being deformed by residual pressure fluctuations in the pressure chamber, the piezoelectric element generating the electric signal by the piezoelectric electric effect corresponding to the residual pressure fluctuations, the piezoelectric element supplying the electric signal to the detection circuit, and wherein the drive circuit selectively applies the compensation voltage pulse and the ejection voltage pulse to the piezoelectric element.

14. A piezoelectric-type liquid droplet ejecting device as claimed in claim 13, wherein the drive circuit includes isolation means for electrically isolating the drive circuit from the piezoelectric element during detection of residual pressure fluctuation in the pressure chamber.

15. A piezoelectric-type liquid droplet ejecting device as claimed in claim 12, wherein the detection element includes another piezoelectric element, the another piezoelectric element being deformed by residual pressure fluctuations in the pressure chamber, the another piezoelectric element generating the electric signal by the piezoelectric electric effect corresponding to the residual pressure fluctuations, the another piezoelectric element supplying the electric signal to the detection circuit, and wherein the drive circuit selectively applies the ejection voltage pulse and the compensation voltage pulse to the piezoelectric element.

16. A piezoelectric-type liquid droplet ejecting device as claimed in claim 2, wherein the calculation circuit determines the compensation voltage pulse which is supplied to the drive circuit for application to the piezoelectric element when residual pressure fluctuation is at a certain level, the residual pressure at the certain level in combination with pressure generated when the piezoelectric element is deformed by the compensation voltage pulse being sufficient to eject a droplet from the pressure chamber.

17. A piezoelectric-type liquid droplet ejecting device as claimed in claim 16, wherein the predetermined voltage is of sufficient voltage and duration for causing the piezoelectric element to deform sufficiently to eject a liquid droplet from the pressure chamber.

18. A piezoelectric-type liquid droplet ejecting device as claimed in claim 17, wherein the calculation circuit includes:

peak detection means for detecting a peak and an ensuing peak in the electric signal;

peak level detection means for detecting peak level of the peak, and the ensuing peak level of the ensuing peak;

half cycle calculation means for calculating a half cycle of the electric signal corresponding to the time duration between when the peak level is detected and when the ensuing peak level is detected;

phase calculation means for calculating a phase based on the predetermined voltage pulse and the peak electric signal; and compensation voltage pulse calculation means for calculating the voltage of the compensation voltage pulse based on the level of the peak, the pulse width of the compensation voltage pulse based on the half cycle, and the application time of the compensation voltage pulse based on the phase.

19. The piezoelectric-type liquid droplet ejecting device as claimed in claim 1, wherein:

the predetermined voltage pulse is a drive voltage pulse supplied for ejecting ink during printing; and the compensation voltage pulse determined by the residual pressure fluctuation compensating means is a residual pressure fluctuation cancel pulse that is determined on a basis of the residual pressure fluctuation generated by application of the predetermined voltage pulse and applied to the piezoelectric element after application of the predetermined voltage pulse to cancel the residual pressure fluctuation generated by application of the predetermined voltage pulse.

20. A piezoelectric-type liquid droplet ejecting device for ejecting ink from a pressure chamber having an internal volume defined by a plurality of walls for containing the ink, the piezoelectric-type liquid droplet ejecting device comprising:

a piezoelectric element associated with at least one wall of the plurality of walls for changing the internal volume of the pressure chamber by deforming the at least one wall of the plurality of walls in response to application of electric voltage;

drive means for applying a drive voltage pulse to the piezoelectric element to drive the piezoelectric element to eject ink from the pressure chamber to print a dot during a printing operation;

piezoelectric residual pressure fluctuation detection means for detecting, following application of the drive voltage pulse for printing the dot and during a continuation of the printing operation, after each application of the drive voltage pulse, residual pressure fluctuation generated in the pressure chamber by application of the drive voltage pulse to the piezoelectric element; and residual pressure calculating means for calculating, after each application of the drive voltage pulse, a cancel voltage pulse that cancels residual pressure fluctuation detected by the residual pressure fluctuation detection means and residual pressure pulse generating means for applying the cancel voltage pulse to the piezoelectric element.

21. The piezoelectric-type liquid droplet ejecting device as claimed in claim 20, wherein the drive means applies the drive voltage pulse a plurality of times to the piezoelectric element to eject a single dot.

* * * * *